US006169241B1

(12) United States Patent
Shimizu

(10) Patent No.: US 6,169,241 B1
(45) **Date of Patent: *Jan. 2, 2001**

(54) SOUND SOURCE WITH FREE COMPRESSION AND EXPANSION OF VOICE INDEPENDENTLY OF PITCH

(75) Inventor: Masahiro Shimizu, Hamamatsu (JP)

(73) Assignee: Yamaha Corporation, Hamamatsu (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/026,960

(22) Filed: Feb. 20, 1998

(30) Foreign Application Priority Data

Mar. 3, 1997 (JP) ..... 9-061723

(51) Int. Cl.[7] ..... G10H 7/00; G10H 7/04

(52) U.S. Cl. ..... 84/605; 84/604; 84/622; 84/626

(58) Field of Search ..... 84/601–605, 622–625, 84/626, 627, 615

(56) References Cited

U.S. PATENT DOCUMENTS 4,370,524 1/1983 Hiraguri .

5,559,994 * 9/1996 Shimizu ..... 395/494

* cited by examiner

*Primary Examiner*—Bentsu Ro
*Assistant Examiner*—Marlon T. Fletcher
(74) *Attorney, Agent, or Firm*—Morrison & Foerster

(57) ABSTRACT

A music apparatus is constructed for generating a music tone at a specified pitch while freely contracting and expanding the music tone along a time axis. In the music apparatus, a waveform memory memorizes a music tone in the form of waveform data composed of a sequence of waveform units arranged in cycles along the time axis. Each waveform unit has a normalized cycle length. A read address generator generates a read address which successively increments at a rate corresponding to the specified pitch, thereby reading out the waveform data from the waveform memory according to the read address. A tone generator processes the read waveform data to generate the music tone at the specified pitch. A virtual address generator generates a virtual address effective to freely contract and expand the time axis of the waveform data. An address controller operates when the read address deviates from the virtual address during the course of generation of the music tone for controlling the read address generator to change the read address by an integer multiple of the normalized cycle length so as to track the virtual address.

34 Claims, 15 Drawing Sheets

FIG.5(a)

| FIRST EXAMPLE OF CYCLE LENGTH NORMALIZATION | |
|---|---|
| ALL TONE RANGES | 1024 SAMPLES/PERIOD |

FIG.5(b)

| SECOMD EXAMPLE OF CYCLE LENGTH NORMALIZATION | | |
|---|---|---|
| BANK NO. | TONE RANGE | SAMPLES/ PERIOD |
| 1 | G0–F#1 | 1024 |
| 2 | G1–F#2 | 512 |
| 3 | G2–F#3 | 256 |
| 4 | G3–F#4 | 128 |
| 5 | G4–F#5 | 64 |
| 6 | G5–F#6 | 32 |
| 7 | G6–F#7 | 16 |
| 8 | G7–F#8 | 8 |

FIG.6

| THIRD EXAMPLE OF CYCLE LENGTH NORMALIZATION | | | |
|---|---|---|---|
| BANK NO. | TONE RANGE | SAMPLES/ PERIOD | SHIFT-DOWN COUNT |
| 1 | G0-A#0 | 1536 | 1 |
| 2 | B0-D1 | 1280 | 2 |
| 3 | D#1-F#1 | 1024 | 0 |
| 4 | G1-A#1 | 768 | 1 |
| 5 | B1-D2 | 640 | 2 |
| 6 | D#2-F#2 | 512 | 0 |
| 7 | G2-A#2 | 384 | 1 |
| 8 | B2-D3 | 320 | 2 |
| 9 | G0-F#1 | 256 | 0 |
| ⋮ | | | |
| 19 | G6-A#6 | 24 | 1 |
| 20 | B6-D7 | 20 | 2 |
| 21 | D#7-F#7 | 16 | 0 |
| 22 | G7-A#7 | 12 | 1 |
| 23 | B7-D#8 | 10 | 2 |
| 24 | D#8-F#8 | 8 | 0 |

SOUND SOURCE WITH FREE COMPRESSION AND EXPANSION OF VOICE INDEPENDENTLY OF PITCH

BACKGROUND OF THE INVENTION

1. Field of the Invention

The present invention generally relates to a music tone generating apparatus for generating a music tone by use of waveform data stored in a wave table memory. This music tone generating apparatus is applicable to a sound source of an electronic musical instrument, a game machine, a personal computer and so on.

2. Description of Related Art

In a typical music tone generating apparatus, waveform data is read from a wave table memory at a rate matching a pitch of a musical tone while an envelope of the read waveform data is controlled so as to generate the music tone. Such a music tone generating apparatus based on the wave table memory has limited ability of controlling timbres at waveform reproduction. A music tone may be formed by steps of preparing plural pieces of waveform data in the wave table memory, selecting the waveform data having a timbre corresponding to performance data from the prepared data, and reading the selected waveform data. For example, a waveform having characteristics corresponding to a particular performance expression is stored in the wave table memory. Actually, the performance expression varies like a short slur and a long slur, and the shape of the music tone waveform vary accordingly. It is impracticable to store all musical tone waveform variations into the wave table memory. Therefore, in order to control a timbre according to performance information, a method is generally practiced in which the waveform data read from the wave table memory is processed or modified by a digital filter having frequency characteristics corresponding to the performance information.

Anyway, the reading of waveform data is only controlled according to the pitch of a music tone to be generated. This causes a problem that the time axis of the waveform data cannot be freely controlled without regard to the pitch of the musical tone. For example, if the reading rate is increased, the pitch goes up but the whole length of the waveform is simply decreased. Conversely, if the reading rate is decreased, the pitch goes down but the whole length of a waveform is simply increased. Also, each time length of leading section, middle section, and trailing section in one waveform is determined by the pitch of the music tone.

If the time axis of the waveform data read from the wave table memory can be arbitrarily controlled, the number of timbres that can be derived from one type of waveform data can be increased. For example, different timbres could be created by altering an attack length of the music tone while maintaining the pitch. Performance expression can also be broadened significantly and diversely. For example, in the reading of a recorded slur waveform, if the waveform is compressed along time axis without altering the pitch, a slur shorter than that at recording could be created. Conversely, if the waveform is expanded, a longer slur could be generated. In the reading of a vibrato waveform, if the waveform is expanded along time axis without altering the pitch, vibrato could slow down; if the waveform is compressed, vibrato could quickens. Either way, the waveform must be expanded or compressed along time axis independently of the pitch.

In the field of voice recording/reproducing, technologies are known in which, in order to make slurred words intelligible, a voice waveform is expanded along time axis without altering the pitch. In another way, the pitch of a reproduced voice is restored to the original pitch at double-speed reproduction. It is possible to apply these technologies to the above-mentioned music tone generating apparatus. However, the pitch of music tones dynamically varies as the waveform data progresses. The above-mentioned time-axis expanding and compressing technology is only applicable to audio signals requiring no pitch control, and therefore hardly applicable to situation in which pitch control on a cent basis is required as in the sound source of an electronic musical instrument. While a music tone waveform must be controlled in different modes for different sounding operations according to the performance information, the conventional time-axis expanding and compressing technology is designed for uniformly processing all waveform data. Therefore, the conventional time-axis expanding and compressing technology involves a problem that the rate of reading waveform data cannot be freely controlled according to the pitch of a music tone to be generated.

Waveform data having a characteristic corresponding to a certain performance expression may be stored into a wave table memory. The shape of the waveform may be altered by skipping or repeating a part of this waveform at the reading from the wave table memory. In such a case, minutely observing the original waveform data, individual periods of the waveform are usually not constant. Therefore, an attempt to perform partial skip or repeat of periods contained in the waveform data simply during the reading from the wave table memory may cause poor joint at boundary, and may make difficult the waveform processing operation for joining the periods of the waveform.

SUMMARY OF THE INVENTION

It is therefore an object of the present invention to provide a music tone generating apparatus capable of freely controlling a pitch of a music tone while allowing the time-axis compression and expansion of a waveform read from a waveform memory, thereby smoothly joining plural pieces of waveform data.

In carrying out the invention and according to one aspect thereof, there is provided a music tone generating apparatus comprising: a waveform memory for storing a plurality of waveform units of one music tone in which a waveform is divided in unit of a plurality of periods to define each waveform unit, of which cycle length is normalized; first address means for generating a read address incrementing at a rate corresponding to a specified pitch of the music tone and for reading the plurality of the waveform units from the waveform memory according to the generated read address; second address means for outputting a virtual address varying temporally; and address control means for generating an alternate read address different from the above-mentioned read address by an integer multiple of the normalized cycle length according to a difference between the above-mentioned read address and the above-mentioned virtual address, and for controlling the above-mentioned first address means such that the above-mentioned plurality of the waveform units are read by the above-mentioned alternate read address instead of the original read address. Thus, this novel constitution can control compression and expansion of time axis of the music tone by the virtual address, thereby allowing the user to control as desired both of the pitch of the music tone to be generated and the compression and expansion of the time axis of the waveform data to be read from the waveform memory. This constitution also allows the user to accurately control the compression rate in the time-axis in the middle of the waveform reading operation. Since the waveform is divided in unit of a plurality of periods, the divided waveform units can be joined smoothly. In addition, the waveform unit is normalized, and the alternate read address differing from the current read address by an integer multiple of the cycle length can be generated, thereby facilitating the joining of the divided waveform units at changing of the read addresses.

In carrying out the invention and according to another aspect thereof, there is provided the music tone generating apparatus further comprising a compression rate memory for storing a compression rate to be used when the above-mentioned music tone waveform is normalized to the above-mentioned sequence of the elementary or individual waveform units. The above-mentioned first address means reads the compression rate from the compression rate memory to alter the rate of reading the waveform unit according to the compression rate. Thus, this novel constitution can not only reproduce the waveform having the same shape as that of an original or source waveform not normalized, but also can alter the pitch of the music tone while the feature of the original recorded waveform before the normalization can be reserved.

In carrying out the invention and according to still another aspect thereof, there is provided the music tone generating apparatus, wherein the above-mentioned first address means has a counter and a regulator for manipulating an output of the counter according to the above-mentioned cycle length to generate $\alpha$ read address, thereby reading the above-mentioned waveform units in an isophase manner regardless of the cycle length. Thus, when a plurality of waveform units are sequentially read in an isophase manner from the waveform memory, the above-mentioned novel constitution can generate the read address by means of the common counter without change even if these waveform units have different cycle lengths. In addition, when two waveform units are simultaneously read in an isophase manner from the waveform memory in concurrent processing based on time-division method, the novel constitution can generate the read address by the common counter even if these waveform units have different cycle lengths.

In carrying out the invention and according to yet another aspect thereof, there is provided the music tone generating apparatus, wherein the above-mentioned cycle length is normalized by a value obtained by multiplying a value expressed in n bits by $2^m$. The above-mentioned first address means has the counter for specifying a read address within one period or cycle of the above-mentioned waveform unit. The first address means also has a detector for determining the end of the one waveform unit by a high-order bit of the counter. Thus, when a plurality of waveform units are sequentially read in an isophase manner from the waveform memory, this novel constitution can determine the end of each waveform unit stored in the waveform memory only by determination of the high-order bit of the common counter even if the waveform units have different cycle lengths or periods. In addition, when two waveform units are simultaneously read in an isophase manner from the waveform memory in the concurrent processing through parallel channels based on time-division method, the novel constitution can determine the end of each waveform unit for each channel by the common counter even if the waveform units have different cycle lengths.

In carrying out the invention and according to a separate aspect thereof, there is provided the music tone generating apparatus further comprising a regulator for generating a read address by manipulating the output of the above-mentioned counter according to the above-mentioned cycle length, thereby reading the waveform units in an isophase manner regardless of the cycle length. Thus, the novel constitution can perform the processing by one counter even if the waveform units have different cycle lengths.

In carrying out the invention and according to a still separate aspect thereof, there is provided the music tone generating apparatus, wherein the above-mentioned address control means compares the above-mentioned read address with the above-mentioned virtual address by a cycle number of the waveform units. This comparison on the cycle basis can easily generate virtual addresses, and can make the comparison in a small number of bits.

In carrying out the invention and according to a yet separate aspect thereof, there is provided a music tone generating apparatus comprising: a waveform memory for storing a plurality of waveform units such that a music tone waveform having a plurality of continuous periods or cycles is divided in unit of one or more periods to define a sequence of the waveform units each having one or more period or cycle; first address means for generating a read address incrementing at a rate corresponding to a specified music tone pitch to read the above-mentioned plurality of waveform units from the waveform memory by the above-mentioned read address, and for outputting a cycle number of the waveform units being read by the first address means; second address means for outputting a virtual address changing temporally; and address control means for detecting that a difference between the above-mentioned cycle number and the above-mentioned virtual address is in excess of a predetermined value and for controlling the above-mentioned first address means such that the read address to be generated by the first address means is altered to make the above-mentioned difference smaller. Thus, this novel constitution can control the compression and expansion of time axis of the music tone waveform by the virtual address, thereby allowing the user to control as desired the pitch of a musical tone to be generated and the compression and expansion of the time axis of the waveform read from the waveform memory. This constitution also allows the user to accurately control the compression rate along the time-axis in the middle of the waveform reading operation. Since the waveform is divided in unit of one or more of periods, the divided waveform units can be joined smoothly. In addition, this novel constitution simplifies the processing for determining the difference between the read address and the virtual address, thereby facilitating the address control processing.

In carrying out the invention and according to a different aspect thereof, there is provided a music tone generating apparatus comprising: a waveform memory for storing a plurality of waveform units such that a complete waveform of one music tone having a plurality of continuous cycles is divided in unit of one or more cycles; first address means for generating a read address incrementing at a rate corresponding to a specified pitch of the music tone and for reading the plurality of the waveform units from the waveform memory by the generated read address; second address means for outputting a virtual address continuously changing as time passes and for making a value of the virtual address jump, at a predetermined timing, to another value spaced from a current value; and address control means for detecting that a difference between the above-mentioned read address and the above-mentioned virtual address is in excess of a predetermined value and for controlling the first address means such that the read address to be generated by the first address means is altered to make the above-mentioned difference smaller. This novel constitution can control the compression and expansion of the time axis by the virtual address, and allows the user to control as desired the pitch of the music tone to be generated and the compression and expansion of the time axis of the waveform read from the waveform memory. This constitution also allows the user to accurately control the compression rate along the time-axis during the waveform reading operation. Since the waveform is divided in unit of one or more period, the divided waveform units can be joined smoothly. In addition, this constitution can simultaneously control the compression and expansion of the time axis and the waveform joining by jumping of the read address according to the virtual address, thereby facilitating the address control processing.

In carrying out the invention and according to a still different aspect thereof, there is provided the music tone generating apparatus, wherein the above-mentioned jump timing is set at which the above-mentioned virtual address exceeds a predetermined loop end address, and a jump destination or target is set to a predetermined loop start address before the loop end address. Thus, this novel constitution can control read address looping only by controlling the looping of the virtual address for the time-axis compression and expansion.

BRIEF DESCRIPTION OF THE DRAWINGS

These and other objects of the invention will be seen by reference to the description, taken in connection with the accompanying drawings, in which:

FIG. 5 (*a*) and FIG. 5 (*b*) are diagrams illustrating first and second examples of cycle length normalization, respectively;

FIG. 6 is a diagram illustrating a third example of cycle length normalization;

DETAILED DESCRIPTION OF PREFERRED EMBODIMENTS

This invention will be described in further detail by way of example with reference to the accompanying drawings.

Figure 1:
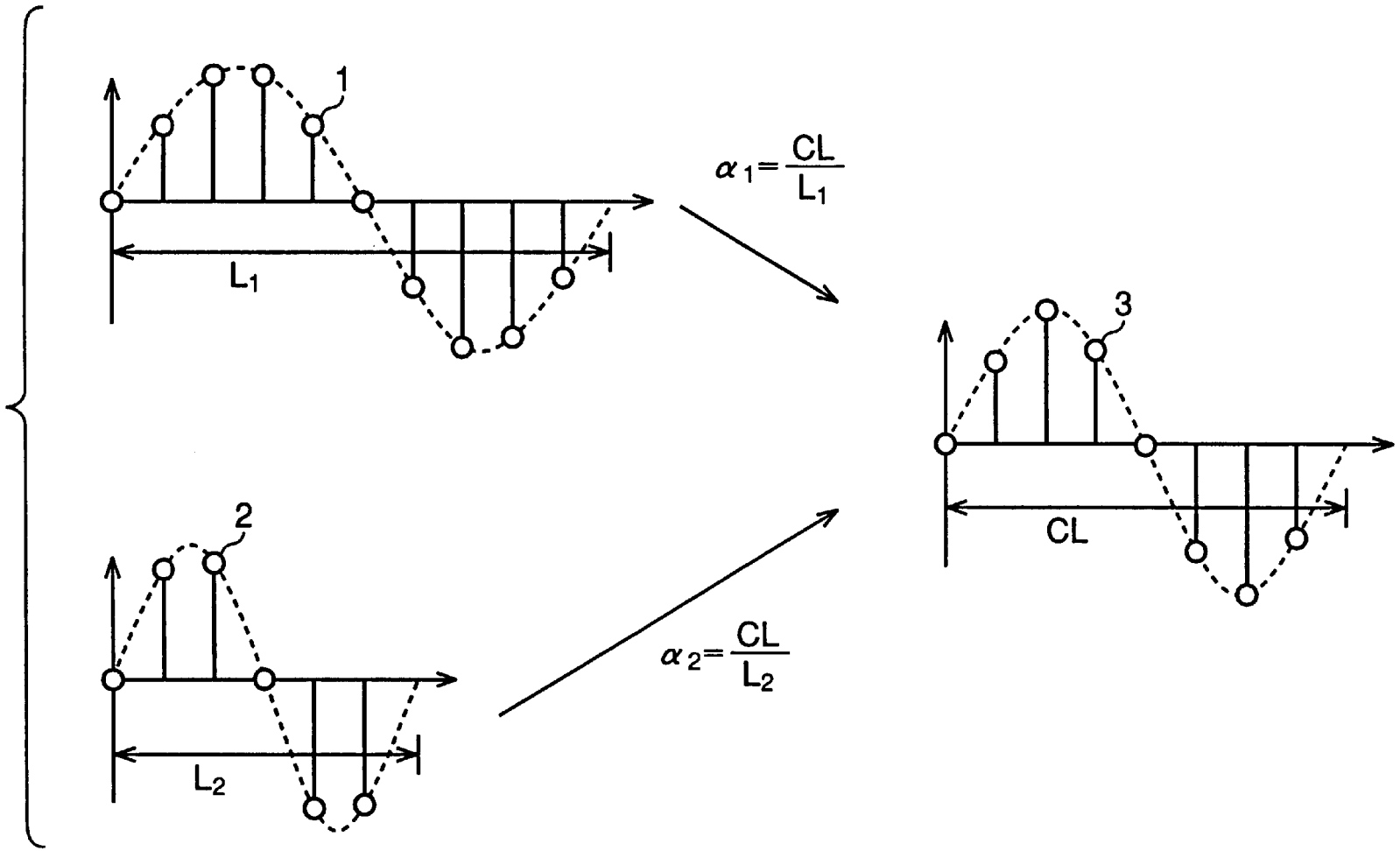
FIG. 1 is a diagram illustrating principles of a method for manipulating music tone waveform data to be stored in a waveform memory of a music tone generating apparatus according to the invention.

Now, referring to FIGS. 1 through 6, a provisional stage in which waveform preparation is performed will be described. FIG. 1 is a diagram illustrating principles of a method for manipulating music tone waveform data to be stored in a waveform memory of a music tone generating apparatus according to the invention. In the figure, reference numeral 1 denotes a sample value of a source waveform having a longer period or a cycle length $L_1$. Reference numeral 2 denotes a sample value of another source waveform having a shorter period or a cycle length $L_2$. Reference numeral 3 denotes a sample value of an object waveform having a normalized cycle length CL. In storing a music tone waveform, the source waveform of the longer cycle length is compressed at a compression rate $\alpha_1=CL/L_1$. The other source waveform of the shorter cycle length is expanded at a compression rate $\alpha_2=CL/L_2$ to form the object waveform with the period normalized to CL. The formed object waveform is stored in a waveform memory.

The compression and the expansion herein are realized by altering the sampling frequency of the waveform data by use of so-called sampling rate conversion technique. This alters the number of samples per period. For example, if the sampling frequency of the waveform data having 100 samples per period is multiplied by 1.5, the waveform data having 150 samples per period is obtained. The source waveform is expanded at a compression rate of $\alpha_2=150/100$. The object waveform of which cycle length is normalized to 150 samples is stored in the waveform memory. Thus, in the waveform preparation processing, the object waveform with the length of the source waveform multiplied by a is generated.

To be more specific, from plural periods of the music tone waveform data, isophase points having the same phase are detected for all periods. The detected points are specified as division points of the source waveform to define a sequence of waveform units each having one or more period. An interval between the adjacent points is defined as one period or cycle. Sample value interpolation is performed such that the number of samples in one period becomes a predetermined number of samples to obtain a sequence of the sample values 3 of the object waveform having the normalized cycle length CL. Since the sampling frequency is constant, the cycle length can be expressed by the number of samples per period. Increasing or decreasing the number of samples per period in the above-mentioned waveform processing compresses or expands the cycle length. It should be noted that $\alpha_2=CL/L_2$ takes a value higher than one but, because the same computational equation as that of the compression is used, the expansion rate is also expressed in terms of the compression rate $\alpha$.

A period dividing point is provided at a position where waveform units are joined relatively smoothly without causing a noise, such that one waveform unit can be joined with another waveform unit that begins from another dividing point discontinuous from the dividing point of the one waveform unit. The points provided at these position are herein referred to as isophase points which have the same phase in the respective periods or cycles. Preferably, the isophase point is a zero cross point at which an amplitude of the waveform becomes zero, for example. A range spanning between adjacent isophase points provides one unit of the waveform data having plural periods. The cycle length CL of the waveform unit is normalized to a predetermined value. A sequence of the waveform units obtained by the normalization processing is stored in the waveform memory.

Thus, in the present invention, the cycle lengths of the waveform units are normalized. The waveform data is manipulated into the waveform units with the cycle lengths CL all set to a certain value, and the resultant waveform units are stored in the waveform memory. At the same time, the compression rate $\alpha$ of the waveform units relative to the source waveform is stored in a cycle data memory. Use of this compression rate $\alpha$ in generation of the music tone allows reproduction of the source waveform without change, while the time-axis compression and expansion of the read waveform data allows the generation of the music tone having a timbre different from that of the source waveform. The cycle lengths of the plural waveform units to be stored in the waveform memory have all been normalized, so that, at the waveform data reading operation, switching from reading of one period or one waveform unit to reading of another period or another waveform unit can be performed easily.

Figure 2:
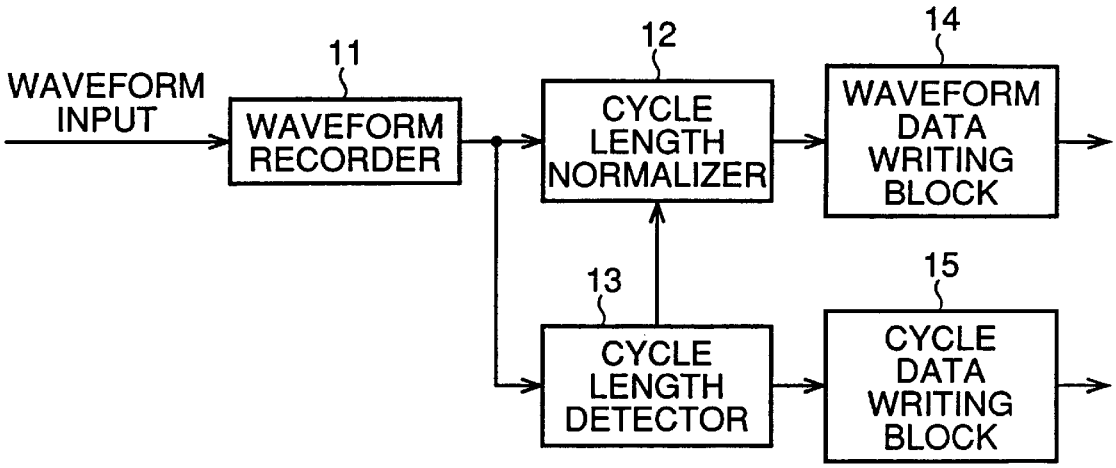
FIG. 2 is a block diagram illustrating a first device for preparing the waveform memory for use in the music tone generating apparatus according to the invention.

FIG. 2 is a block diagram illustrating a first device for preparing the waveform memory for use in the music tone generating apparatus according to the invention. In the figure, reference numeral 11 denotes a waveform recorder, reference numeral 12 denotes a cycle length normalizer, reference numeral 13 denotes a cycle length detector, reference numeral 14 denotes a waveform data writing block, and a reference numeral 15 denotes a cycle data writing block. An input waveform is digitally sampled and recorded by the waveform recorder 11. At reproduction, the lengths of plural periods of the recorded waveform data are automatically detected by the cycle length detector 13. It should be noted that the length of each period may also be specified by the user manually. The cycle length detector 13 determines the length of each period ($L_1$ or $L_2$ in the example shown in FIG. 1) to determine the compression rate $\alpha$. The compression rate $\alpha$ is a value obtained by dividing the normalized cycle length of the object waveform by the cycle length of the source waveform. The cycle length normalizer 12 performs compression and expansion based on the determined compression rate $\alpha$ to set the cycle lengths CL of the plural units of the waveform data to a predetermined length, thereby generating the normalized waveform data. The waveform data writing block 14 generates a wave table from the normalized waveform data. The cycle data writing block 15 writes to the cycle data memory the compression rate $\alpha$ or a compression rate $\alpha'$ which is cent equivalent of the compression rate $\alpha$.

Figure 3:
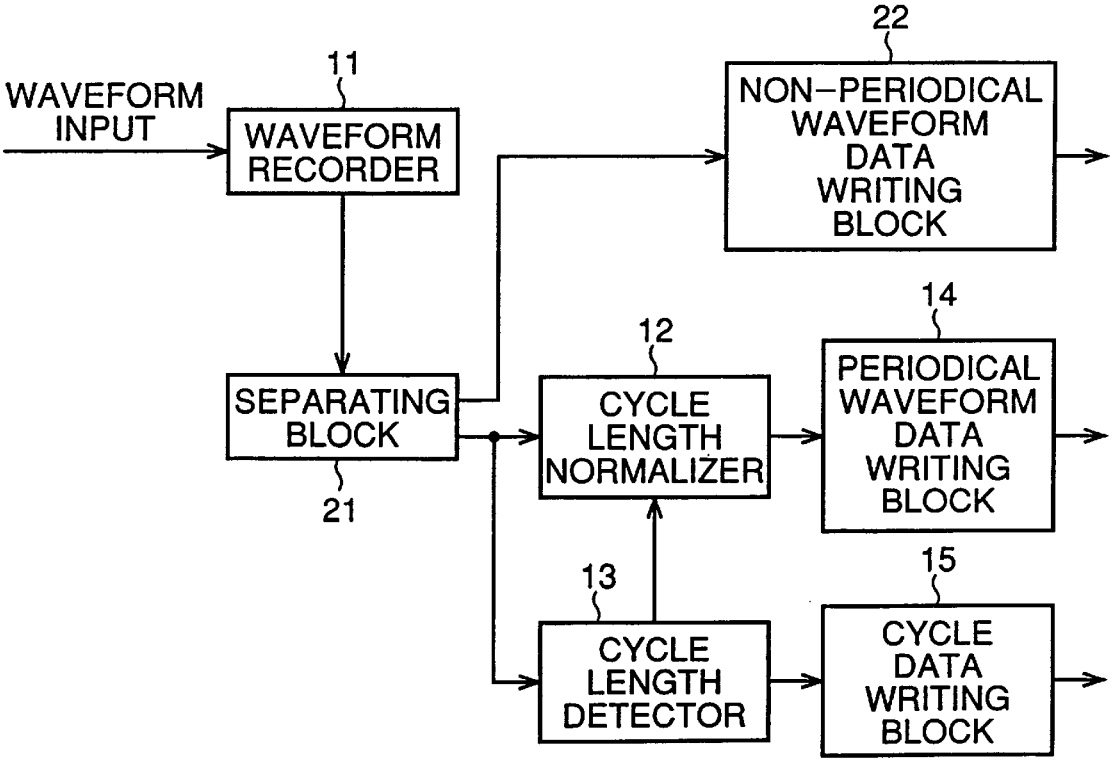
FIG. 3 is a block diagram illustrating a second device for preparing the waveform memory for use in the music tone generating apparatus according to the invention.

In the music tone generating apparatus practiced as one preferred embodiment of the invention, the waveform data prepared by the above-mentioned method is used. It should be noted that the waveform data may also be prepared by a device described below. FIG. 3 is a block diagram illustrating a second device for forming a wave table in the waveform memory for use in the music tone generating apparatus according to the invention. With reference to FIG. 3, components similar to those previously described with FIG. 2 are denoted by the same reference numerals for simplicity. Reference numeral 21 denotes a separating block and reference numeral 22 denotes a non-periodic waveform writing block. Unlike the first device shown in FIG. 2, the second device separates the recorded waveform data into a periodic component and a non-periodic component by the separating block 21. The non-periodic component is written to the waveform memory by the non-periodic waveform writing block 22 without change. As for the periodic component, the cycle lengths are all set to a predetermined value as in the first device of FIG. 2, and the resultant waveform is written to the waveform memory. The non-periodic waveform and the periodic waveform are stored such that both can be read in synchronization with each other. The separating block 21 may be composed of a filter for separating a frequency band having a high ratio of periodic component. Alternatively, the separating block 21 may be composed of a gate circuit or the like for separating an interval having a high ratio of periodic component in one waveform. In a music tone formation using the above-mentioned non-periodic waveform data and periodic waveform data, two channels of a sound source are used. In one channel, the non-periodic waveform data is read in a normal manner; in the other channel, the periodic waveform data is read with the time axis thereof being compressed and expanded.

Figure 4A:
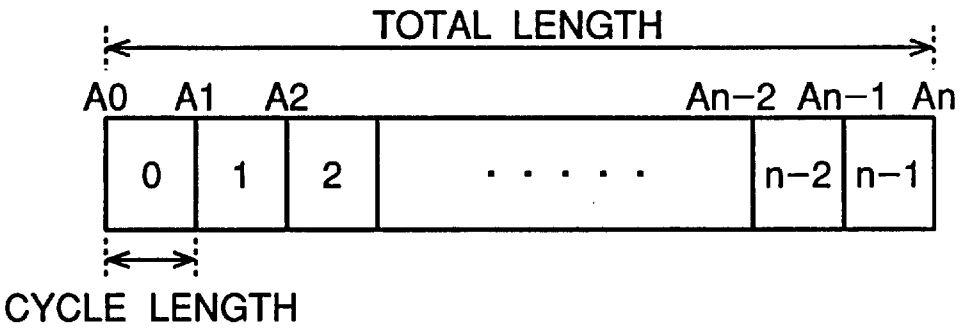
FIG. 4 (*a*) and FIG. 4 (*b*) are schematic diagrams illustrating storage formats of waveform data to be stored in the waveform memory in the music tone generating apparatus according to the invention.
Figure 4B:
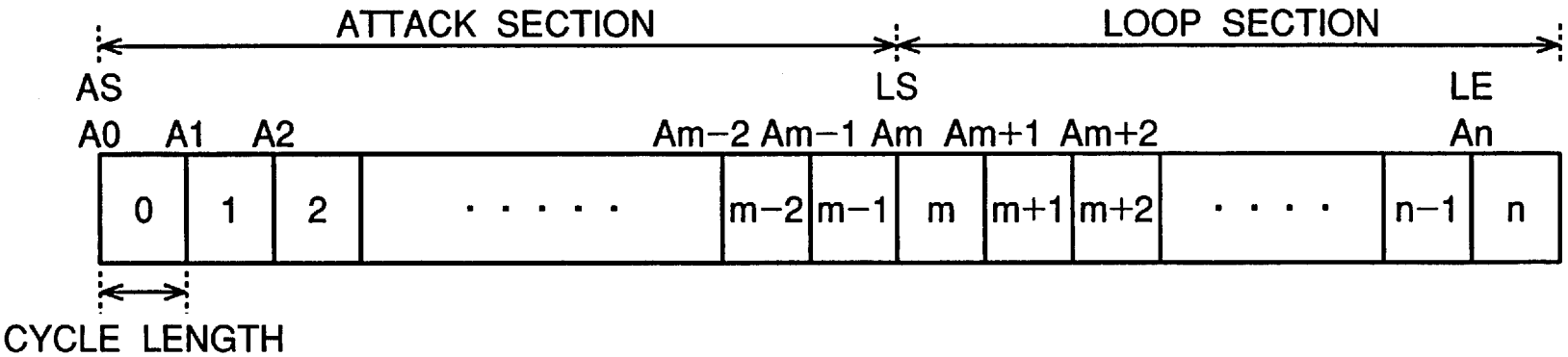

FIG. 4 (*a*) and FIG. 4 (*b*) are schematic diagrams illustrating storage formats of waveform data to be stored in the waveform memory in the music tone generating apparatus according to the invention. FIG. 4 (*a*) shows an example in which a series of waveform units from top to end are stored. FIG. 4 (*b*) shows an example in which the waveform units of an attack section and the waveform units of a loop section are taken out to be stored in the waveform memory. As shown in FIG. 4 (*a*), for plural periods of a music tone generated from an acoustic musical instrument, the cycle length of each waveform unit of waveform data is set to a predetermined normalized length. In other words, the cycle length is set such that a predetermined number of samples is obtained per period of the waveform unit. The resultant waveform data is stored in the waveform memory at each address sequentially arranged from top to end. In the figure, A0 through An−1 denote start addresses in period 1 through period n−1 of the normalized waveform units. In the plural units or periods of the source waveform, an isophase point for each period is determined. Normalization is performed such that the interval between adjacent isophase points provides a cycle length CL. As a result, each start address Ai of each period or unit i after the normalization is arranged at a certain interval equal to the cycle length CL.

Referring to FIG. 4 (*b*), when a music tone of an acoustic musical instrument has been produced, the waveform of an attack portion and a loop portion are extracted. Like the example shown in FIG. 4 (*a*), A0 through An are start addresses of period 0 through period n of the normalized waveform data. These start addresses are arranged at an interval equal to the cycle length CL. The waveform units of the attack portion correspond to a period 0 through a period m−1 from the start address AS=A0. The waveform units of the loop portion correspond to a period m through a period n from a start address LS=Am. One modulation period of a modulated waveform having periodicity of vibrato, tremolo, or trill provides the waveform data of the loop portion as well as a normal stable waveform. The modulating frequency is several Hz to several tens Hz in vibrato for example. Also, plural modulation periods may provide the loop portion.

It should be noted that, in order to smoothly connect a point returning from the end of the loop portion to the start thereof, a waveform obtained by cross-fading the waveforms at the end and at the top taken out for the loop portion may be stored at the end of the loop portion. Also, a middle of the waveform of the attack portion may be cut out to cross-fade both sides of the resultant waveform. The waveform shortened in the attack portion length may be stored. In the example of FIG. 4 (*b*), the compression rate $\alpha$ for each period is also stored as the cycle data. However, because the compression rate $\alpha$ does not change much in other than the attack portion, the compression rate may only be stored once for plural periods.

So far, the normalized waveform units are all set to the same cycle length regardless of the pitch of the music tone. In other words, the number of samples per period is the same for all the normalized waveform data. The cycle length CL to be normalized may be changed according to the pitch or other conditions. FIG. 5 (*a*) and FIG. 5 (*b*) are diagrams illustrating first and second examples of the cycle length normalization, respectively. FIG. 5 (*a*) shows the first example in which the cycle lengths of the units included in one piece of the waveform data are all set to a single same value without depending on timbre and pitch. For example, one cycle length is set to 1 k (1024) samples. In the following example, description will be made with 1024 samples as a reference value, which is for description only.

FIG. 5 (*b*) shows the second example, in which the cycle lengths of the waveform units are made different for tone ranges in terms of octaves. A memory bank is allocated for each tone range. In tone range G0 to F#1, the number of samples per period is 1024. Every time octave increments by one, the number of samples is halved. In tone range G7 to F#8, the number of samples is 8. In one piece of waveform data, the sample cycle length (the number of samples) is set to the same value since one music tone corresponding to one piece of the waveform data has a specified and fixed pitch.

It should be noted that two or more periods may provide one waveform unit. For example, in tone range G1 to F#2, two periods are added together to provide one waveform unit containing 1024 samples. This reduces digits of the cycle number to be used for identifying each of the plural waveform units, thereby eventually reducing the number of bits of the counter for addressing the waveform memory. This is especially effective for tone ranges of higher octave because the number of samples contained in one waveform unit is smaller in these ranges.

FIG. 6 is a diagram illustrating a third example of the cycle length normalization. The cycle lengths are made different for the tone ranges divided in terms of four semitones. Memory banks are allocated to the respective tone ranges. In tone range G0 to A#0, the number of samples per period is 1536. Every time the tone range increments by one, the number of samples is reduced by 5/6 to 3/4. The number of shift-down counts indicates an operation of the shift register attached to the 1024-bit counter. Each of the waveform units or periods has same number of samples throughout one piece of waveform data.

So far, the cycle lengths are set to a common value corresponding to the tone range of the waveform from the top to end. Alternatively, the cycle lengths may be switched during sounding according to a sounding interval by increasing the cycle length in the attack portion and by decreasing the cycle length in the sustain portion, for example. In the above-mentioned examples, the waveform data belonging to one timbre is processed. If waveform data of plural timbres are prepared, the cycle length may be determined for each timbre independently.

In the above-mentioned variation, the cycle lengths are made different by tone ranges, sounding interval, and timbre. Compared with the case in which the cycle lengths are not normalized at all, the end of the element waveform or the waveform unit can be easily detected by a counter for counting the number of samples per period. Therefore, the address reading process can be easily connected to the start address of a next waveform unit. At the same time, the waveform units or element waveforms can be smoothly joined together. Sometimes, waveform data of plural variations (waveforms of heavy touch and light touch, waveforms having modulation and not having modulation, and so on) are prepared in one timbre kind. In this case, the waveform units in these variations are cut and determined in phase with each other. In middle of reading of a certain period of the waveform data of one variation, this setup can switch to reading of any period of the waveform data of another variation while suppressing noise.

Figure 7:
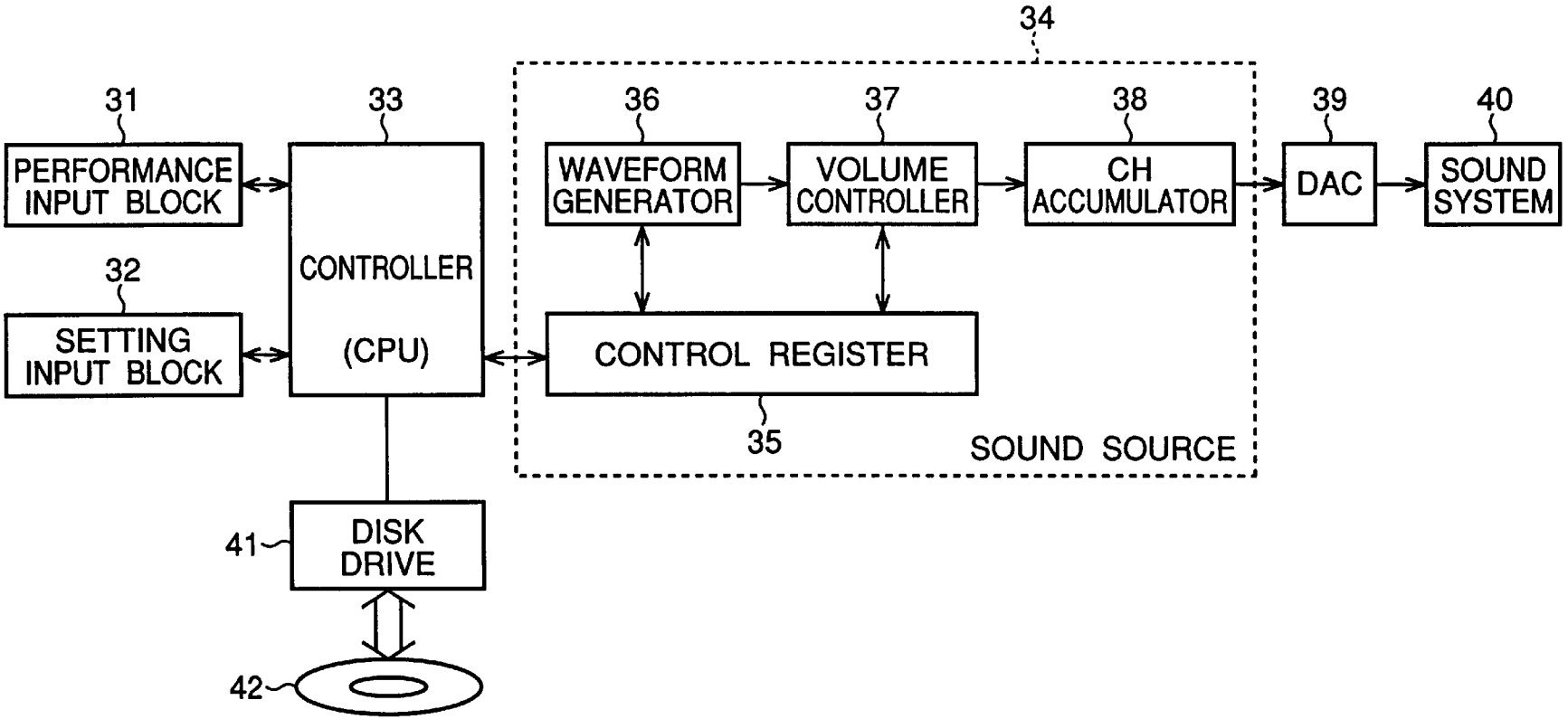
FIG. 7 is a block diagram illustrating an overall constitution of the music tone generating apparatus practiced as one preferred embodiment of the invention.

FIG. 7 is a block diagram illustrating an overall constitution of the music tone generating apparatus practiced as one preferred embodiment of the invention. In the figure, reference numeral 31 denotes a performance input block, reference numeral 32 denotes a setting input block, reference numeral 33 denotes a controller, reference numeral 34 denotes a sound source block, reference numeral 35 denotes a control register, reference numeral 36 denotes a waveform generator, reference numeral 37 denotes a volume controller, reference numeral 38 denotes a channel accumulator, reference numeral 39 denotes a DAC, and reference numeral 40 denotes a sound system. The performance input block 31 includes a MIDI keyboard, a MIDI guitar, a wheel switch, a pedal switch, a joy stick, and other performance operator controls, or a combination of these controls, and an automatic performance device for generating performance information such as a sequence of MIDI events. The setting input block 32 includes a display device, a panel switch, a slider, a jog dial, and other controls, by which the user inputs setting information, which is displayed on the display device. The controller 33 includes a CPU, a ROM, a RAM, and other peripheral devices to set the music tone generating apparatus according to the setting information and to control the sound source block 34 according to the performance input information. A disk drive 41 is connected to the controller 33 and receives a machine readable medium 42 such as floppy disk and CD-ROM disk. The machine readable medium 42 is for use in the music tone generating apparatus having the CPU in the controller 33 for generating a music tone or voice at a specified pitch while freely contracting and expanding the voice along a time axis. The machine readable medium 42 contains program instructions executable by the CPU for causing the apparatus to perform the music tone generation.

The control register 35 in the sound source block 34 holds timbre specifying data, pitch data, envelope data, and note-on/note-off data supplied from the controller 33. The waveform generator 36 receives control data from the control register 35 to generate waveforms through plural channels in a time division manner. The volume controller 37 imparts a volume variation characteristic from start to end of a music tone to the generated waveform of each channel. The volume controller 37 generates envelops of attack, decay, sustain, and release (ADSR) types after note-on, and multiplies the waveform generated by the waveform generator 36 by these envelopes to control volume. The operations of the waveform generator 36 and the volume controller 37 are independently performed for each sounding channel. The channel accumulator 38 accumulates the waveforms fed from the plural channels imparted with the envelope characteristics, and supplies the resultant waveform to the DAC (D/A converter) 39. The DAC 39 outputs the resultant analog waveform to the sound system 40.

Figure 8:
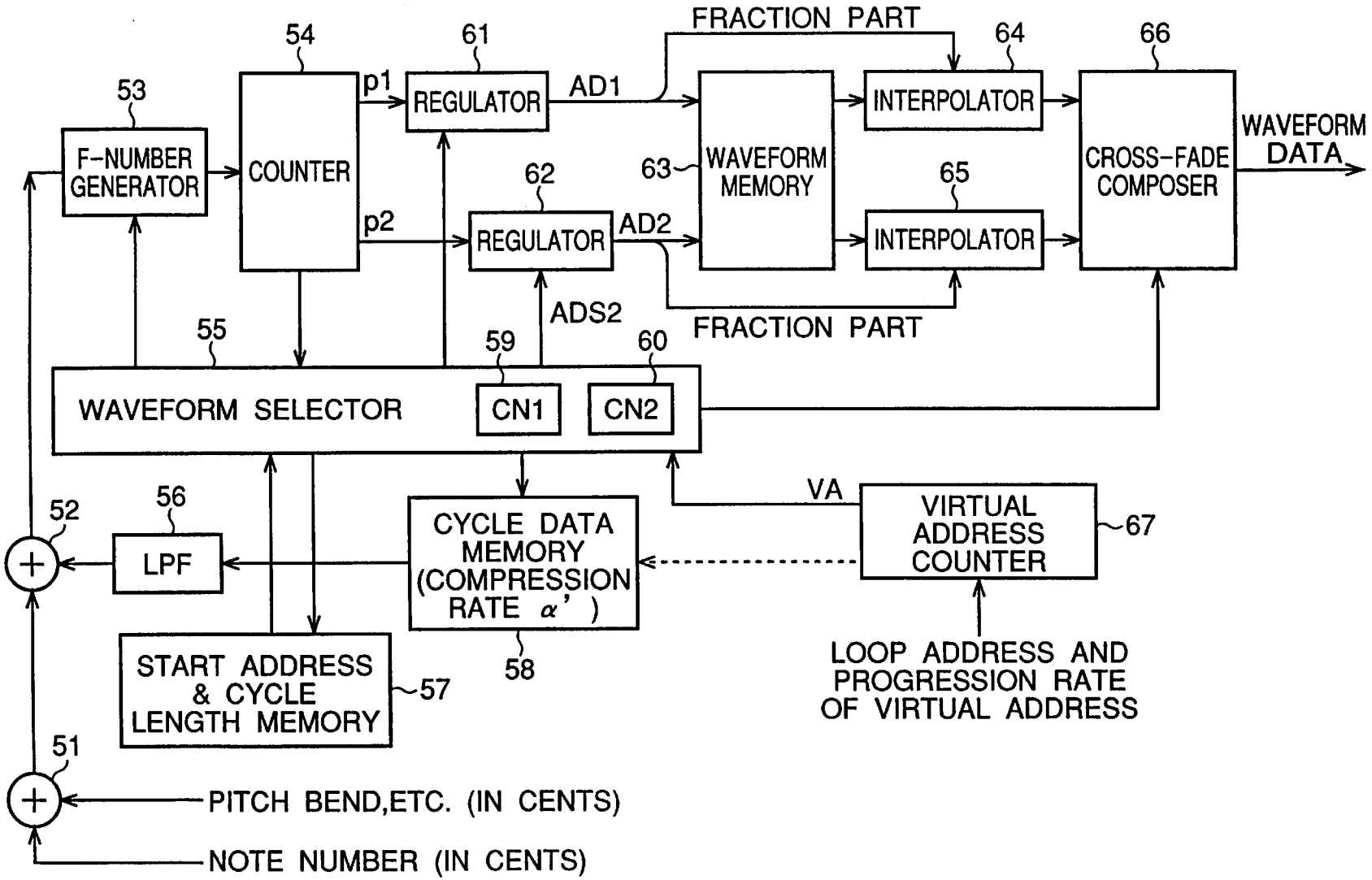
FIG. 8 is a block diagram illustrating an internal constitution of a waveform generating block shown in FIG. 7.

FIG. 8 is a block diagram illustrating internal constitution of the waveform generating block 36 shown in FIG. 7. In the figure, reference numerals 51 and 52 denote adders, reference numeral 53 denotes an F-number generator, reference numeral 54 denotes a counter, reference numeral 55 denotes a waveform selector, reference numeral 56 denotes an LPF, reference numeral 57 denotes a start address & cycle length memory, reference numeral 58 denotes a cycle data memory, reference numeral 59 denotes a first cycle number register, reference numeral 60 denotes a second cycle number register, reference numeral 61 denotes a first regulator, reference numeral 62 denotes a second regulator, reference numeral 63 denotes a waveform memory, reference numeral 64 denotes a first interpolator, reference numeral 65 denotes a second interpolator, reference numeral 66 denotes a cross-fade composer, and reference numeral 67 denotes a virtual address counter.

In the above-mentioned preferred embodiment, two series of waveforms are read from the waveform memory 63 for one sounding channel by offsetting read addresses. The virtual address counter 67 indicates a locus of the addresses along which the waveform data should read from the waveform memory 63 as time passes. The waveform selector 55 makes the read address to follow or track the virtual address VA by alternating these two series of waveforms. At the same time, the waveform selector 55 controls the cross-fade composer 66 to select one of the two series of waveforms or synthesizes the same.

If continuous periods or units of one piece of waveform data are read sequentially, the reading is performed by use of only one of the two series of waveforms. If there is discontinuation between the periods to be read, a next period following the period read last is read in one series, while a new period of jump destination is read in the other series. These two series of waveforms are put together by the cross-fade composer 66 for smooth joining of the waveforms.

In the present preferred embodiment, F-number (frequency number) computing is used as phase data for indicating a sample point address in one waveform unit stored in the waveform memory 63. A value proportional to a pitch frequency of a particular key is accumulated by the counter 54. The integer part of the accumulated value is used as the sample point address in the waveform unit, thereby reading the sample value in real time.

A note number (in unit of cents) proportional to the pitch frequency of each key is added to a pitch offset input (in unit of cents) such as a pitch bend by the adder 51. In the other adder 52, the note number is added to an output of the LPF (lowpass filter) 56, the result data being inputted in the F-number generator 53. The pitch offset input data also includes detune data for specifying offset from reference pitch, low-frequency waveform data generated by an LFO (low-frequency oscillator), and pitch envelope data generated by the pitch envelope generator. These pieces of pitch offset data are supplied to the F-number generator 53 separately or in combination.

The LPF 56 composed of a digital lowpass filter receives the compression rate $\alpha'$ for each waveform unit from the compression rate memory 58, filters the received compression rate for smooth variation, and outputs the filtered compression rate to the adder 52. The compression rate memory 58 stores the compression rate $\alpha'$ which is cent equivalent of the compression rate $\alpha$ of each waveform unit used for manipulating the source waveform data. The above-mentioned note number and the pitch offset input are both in unit of cents, so that these are only added together instead of multiplication. The addition of the compression rate $\alpha'$ results in the multiplication of the compression rate in terms of frequency. Therefore, the normalized cycle length of the waveform unit is restored to the variable original cycle length before normalization. If the normalized cycle length is used as it is and therefore need not be restored to the original waveform data at the time of recording, the compression rate $\alpha'$ need not be added.

As described with reference to FIG. 5(*b*), in the second example of cycle length normalization, the cycle length (the number of samples) of the waveform unit to be used for tone generation differs from one tone range to another tone range. Considering this point, the F-number generator 53 outputs frequency information (F-number) corresponding to a sounding pitch. Also, as shown in FIG. 6, in the third example of cycle length normalization, the count range (the number of bits to be masked) of the counter 54 is the same in every three banks 1 through 3, 4 through 6, 7 through 9, and so on, so that every bank group has the same F-number.

The counter 54 accumulates the F-number. To the integer part, 10 bits are allocated because the F-number may be counted up to 1024 at maximum. The fractional part uses about 15 bits to generate a music tone having a correct pitch asynchronously. Therefore, the counter 54 uses a total of about 25 bits for one read address. The counter 54 is reset by note-on, accumulates the F-number for each channel in each sampling period, and outputs pointers p1 and p2 for reading the waveform units of the two series in parallel.

From the start address & cycle length memory 57, the waveform selector 55 receives a start address AO and a cycle length CL of the waveform data to be read when instructed by the CPU in the controller 33 shown in FIG. 7. Therefore, the start address & cycle length memory 57 stores the start address of the selected waveform data and the cycle lengths, a value of which may be common to all waveform units.

The first cycle number register 59 and the second cycle number register 60 in the waveform selector 55 hold a cycle number CN1 (cycle number) and a cycle number CN2, respectively, for the two series. The cycle number CN1 and the cycle number CN2 are values equivalent to the "periods i after normalization" in the description made with reference to FIG. 4. In other words, the "periods i after normalization" are specified by the cycle number CN1 and the cycle number CN2. The start address of each waveform unit in one object waveform is computed by the following equations for the two series:

$$ADS1=A0+CL\times CN1$$

$$ADS2=A0+CL\times CN2$$

Thus, the start address of each waveform unit can be easily obtained even if not stored in advance. Therefore, plural waveform units can be easily joined together as desired.

The waveform selector 55 sends the start addresses ADS1 and ADS2 to the regulators 61 and 62, and sends a command thereto to alter a specification range of the pointers p1 and p2 according to the cycle length CL. The waveform selector 55 also monitors the output of the counter 54 to detect the time at which the pointers p1 and p2 pass through the range of the normalized cycle length CL, or the time at which one specified waveform unit has been read, thereby controlling the connection to a next waveform unit with that timing. It should be noted that the end timing depends on the bank used.

The waveform unit is normalized by the cycle length (the number of samples) obtained by multiplying a number in which one period is expressed in n bits by $2^m$. For example, in the example of normalization shown in FIG. 5(*b*), m=3 and n=7 for bank 1, m=3 and n=6 for bank 2, m=3 and n=5 for bank 3, and m=3 and n=0 for bank 8. The integer part of the counter 54 is composed of m+n=10 bits. The read address of the sample point in one period of the waveform unit is specified by the integer part of the pointer p1 and p2. For bank 1, detection of inversion from 1 to 0 of the most significant bit 10 can determine the end of the waveform unit. Likewise, for bank 2, detection of the inversion of bit 9 can determine the end of the waveform unit. For bank 3, detection of the inversion of bit 8 can determine the end of the waveform unit. For bank 8, detection of the inversion of bit 3 can determine the end of the waveform unit. Thus, if the normalization shown in FIG. 5(*b*) is performed, one address counter can be shared even if plural waveform units having different cycle lengths are sequentially read from the waveform memory, thereby determining the end of the waveform unit only by the high-order bit of the counter 54. Although illustration is omitted, a pair of waveform data pieces may be read from the waveform memory in the first series and the second series in concurrent processing in a time division manner. In such a case, the number of samples per period of the first waveform data read in the first series may differ from the number of samples per period of the second waveform data read in the second series. In this case the common address counter 54 is shared between the two series. Therefore, the end of the waveform unit can be determined for each series only by the high-order bit of the counter 54.

Figure 9A:
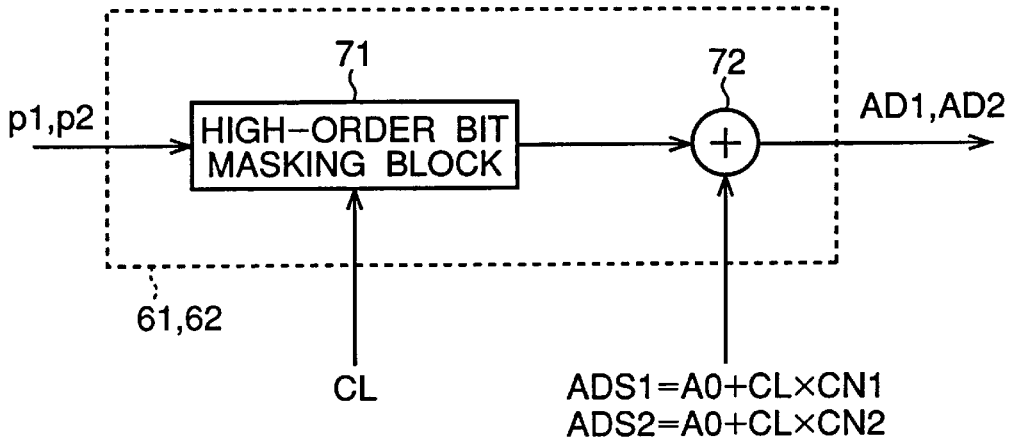
FIG. 9 (*a*) and FIG. 9 (*b*) are block diagrams illustrating internal constitutions of first and second regulators shown in FIG. 8.
Figure 9B:
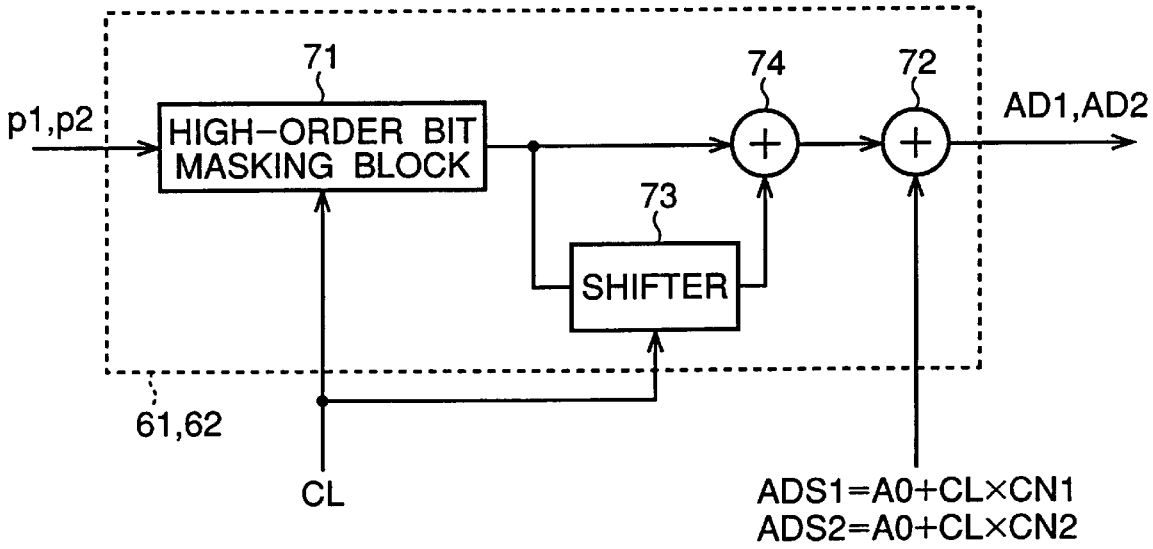

FIG. 9(*a*) and FIG. 9(*b*) are block diagrams illustrating internal constitution of the first and second regulators 61 and 62 shown in FIG. 8. The constitution shown in FIG. 9(*a*) is used for the second example of the cycle length normalization described with reference to FIG. 5(*b*). The constitution of FIG. 9(*b*) is used for the third example of the cycle length normalization described with reference to FIG. 6. In the figures, reference numeral 71 denotes a high-order bit masking block, reference numeral 72 denotes an adder, reference numeral 73 denotes a shifter, and reference numeral 74 denotes another adder. Referring to FIG. 9(*a*), the high-order bit masking block 71 receives a cycle length CL. For bank 1 shown in FIG. 5(*b*), the high-order bit masking block 71 outputs all bits without change. For bank 2, the high-order bit masking block 71 masks one high-order bit by 0 to make the number of bits 9. For bank 3, the high-order bit masking block 71 masks two high-order bits to make the number of bits 8. The p1 and p1 reduced in the number of bits are added to the start address ADS1 and the start address ADS2 of the waveform unit to be read, respectively. The result of this addition is outputted to the waveform memory 63 as the read address. This holds the same with bank 4 and subsequent banks. Consequently, for bank 1, addresses AD1 and AD2 outputted from the regulators 61 and 62 vary at a rate corresponding to the F-number in a range of 1024 samples starting from the start addresses ADS1 and ADS2, respectively. For bank 2, the addresses AD1 and AD2 vary in a range of 512 samples from the start addresses. For bank 3, the addresses AD1 and AD2 vary in a range of 256 samples from the start addresses. Thus, the addresses varying within the ranges corresponding the banks are outputted.

As described, if the normalization shown in FIG. 5(*b*) has been performed, when plural waveform units having different cycle lengths are sequentially read from the waveform memory, one address counter can be shared to generate read addresses varying in-phase only by changing the bit mask. Also, as described, when waveform data is read from the waveform memory in the first and second series in concurrent processing in a time division manner, one address counter can be shared even if the cycle length of the first waveform data read in the first series differs from the cycle length of the second waveform read in the second series. Therefore, the read addresses of these series can be generated in-phase only by changing the bit mask for each series.

As shown in FIG. 9(*b*), the high-order bit masking block 71 sets 10 bits without masking for banks 1 through 3 shown in FIG. 6. The high-order bit masking block 71 makes the number of bits 9 for the banks 4 through 6. The high-order bit masking block 71 makes the number of bits 8 for the banks 7 through 9. The high-order bit masking block 71 makes the number of bits smaller for the banks 10 through 12 and subsequent banks by masking. In addition, for the banks 1, 4, and 6, the adder 74 adds the pointers p1 and p2 after the bit masking to outputs obtained by shifted down by one bit (½ times) by the shifter 73. Thus, the pointers eventually multiplied by 3/2 are outputted. For the banks 2, 5, 7, and so on, the pointers are added to the outputs obtained by shifting down by two bits (¼ times) by the shifter 73, and the pointers eventually multiplied by 5/4 are outputted. For the banks 3, 6, 9, and so on, the pointers after bit masking are outputted without change. Therefore, the addresses AD1 and AD2 outputted from the regulators 61 and 62 vary at a rate according to the F-number within a range of 1536samples starting from the start addresses ADS1 and ADS2 for the bank 1 shown in FIG. 6. For the bank 2, the addresses AD1 and AD2 vary within a range of 1280 samples. For the bank 3, these addresses vary within a range of 1024 samples. For the bank 4, these addresses change within a range of 768 samples, and so on. Thus, the addresses varying within the ranges corresponding to the banks are outputted from the regulators.

The following describes basic operation for reading the waveform data from the waveform memory 63 with reference to FIG. 8 again. Waveform data stored at address AD1=(ADS1+p1) and waveform data stored at address AD2=(ADS1+p2) are read in parallel in two series for one channel. The read pointers p1 and p2 start from 0 at the time when reading of each waveform unit starts, and the read pointers p1 and p2 increment at a rate determined by F-number and shift quantity of the shifter 73 corresponding to a music tone pitch. The start addresses ADS1 and ADS2 have only integer parts, while the F-number and the pointers p1 and p2 have both integer parts and fraction parts, so that the read addresses AD1 and AD2 become addresses composed of integer parts and fraction parts. From the waveform memory 63, sample values at the addresses indicated by the integer parts of the read address AD1 and AD2 and other sample values stored at immediately preceding addresses are read for each series, and are outputted to the first and second interpolators 64 and 65, respectively.

The first and second interpolators 64 and 65 interpolate two sample values read in each series according to the fraction parts of the read addresses AD1 and AD2, respectively. Consequently, the interpolated sample values of two series corresponding to the integer parts and fraction parts of the read addresses AD1 and AD2 are outputted. The cross-fade composer 66 operates upon reception of a cross-fade command for gradually lowering or fading out the level of the interpolated sample value of one series before switching from the maximum, and for gradually raising or fading in the level of the other series after switching from zero. In addition, the cross-fade composer 66 adds the interpolated sample values of the two series after the level control together to obtain the sample value of the waveform data to be outputted. If no cross-fade command is issued, the cross-fade composer 66 maintains the maximum value of the level of the series faded in immediately before and the level of the other series at zero, thereby outputting the waveform data obtained by synthesizing both series.

Referring again to FIGS. 7 and 8, the inventive music apparatus is constructed for generating a music tone at a specified pitch while freely contracting and expanding the music tone along a time axis. In the music apparatus, the waveform memory 63 memorizes a music tone in the form of waveform data composed of a sequence of waveform units arranged in cycles along the time axis. Each waveform unit has a normalized cycle length. A read address generator including the counter 54 and the regulator 61 generates a read address AD1 which successively increments at a rate corresponding to the specified pitch, thereby reading out the waveform data from the waveform memory 63 according to the read address. A tone generator including the interpolator 64 and the cross-fade composer 66 processes the read waveform data to generate the music tone at the specified pitch. Characterizingly, a virtual address generator including the virtual address counter 67 generates a virtual address VA effective to freely contract and expand the time axis of the waveform data. An address controller including the waveform selector 55 operates when the read address AD1 deviates from the virtual address VA during the course of generation of the music tone for controlling the read address generator to change the read address AD1 by an integer multiple (ADS1) of the normalized cycle length so as to track the virtual address.

The inventive music apparatus further comprises the compression rate memory 58 that memorizes a compression rate $\alpha$ by which each waveform unit is compressed to normalize a cycle length of each waveform unit. The read address generator adjusts the rate of the read address according to the compression rate $\alpha$ memorized in the compression rate memory 58.

As noted above, the read address generator comprises the counter 54 that operates based on the pitch of the music tone for successively outputting a pointer p1 effective to regulate a phase of each waveform unit to be read out, and the regulator 61 that processes the pointer p1 according to a different normalized cycle length of each waveform unit for generating the read address AD1 so that each waveform unit can be read out in the same phase without regard to the different normalized cycle length.

Each waveform unit contains sample values in number of $2^x$ where X is determined according to the normalized cycle length. The read address generator comprises the counter 54 that counts a binary number represented by Y bits so as to generate the read address where Y is not less than X, and a detector or the bit masking block 71 that detects an end point of reading of each waveform unit when the counter 54 carries the binary number at bit X. In such a case, as described before, the counter 54 operates based on the pitch of the music tone for successively outputting the pointer p1 effective to regulate a phase of each waveform unit to be read out. The regulator 61 processes the pointer P1 according to a different normalized cycle length of each waveform unit for generating the read address AD1 so that each waveform unit can be read out in the same phase without regard to the different normalized cycle length.

Specifically, the read address generator generates the read address AD1 including a read cycle number which successively designates each waveform unit. The virtual address generator generates the virtual address VA including a virtual cycle number which successively designates each waveform unit The address controller operates when the read cycle number deviates from the virtual cycle number during the course of generation of the music tone for controlling the read address generator to change the read cycle number so as to track the virtual cycle number. In such a case, the address controller operates when a cycle number difference between the read cycle number and the virtual cycle number exceeds a predetermined value during the course of production of the music tone for controlling the read address generator to change the read cycle number so as to reduce the cycle number difference below the predetermined value.

The read address generator normally generates a continuous read cycle number which successively designates each waveform unit. The virtual address generator occasionally generates a discontinuous virtual cycle number which designates jump from one waveform unit to another waveform unit. The address controller operates in response to the discontinuous virtual cycle number for controlling the read address generator to discontinuously change the continues read cycle number so as to track the virtual cycle number. For example, the virtual address generator normally generates a continuous virtual cycle number during loop cycles between a loop start cycle and a loop end cycle, and occasionally generates a discontinuous virtual cycle number which designates jump from the loop end cycle to the loop start cycle The inventive music apparatus further comprises a sampler in the form of the waveform recorder 11 that provides waveform data by digital sampling of a music tone, an analyzer in the form of the cycle length detector 13 that analyzes the waveform data to determine a cycle length of each waveform unit contained in the waveform data, and the cycle length normalizer 12 that selectively compresses and expands each waveform unit to normalize the cycle length.

The present invention further covers a voicing apparatus for generating a voice at a specified pitch while freely contracting and expanding the voice along a time axis. In the inventive voicing apparatus, memory means is composed of the waveform memory 63 for memorizing a voice in the form of waveform data composed of a sequence of waveform units arranged in cycles along the time axis. Each waveform unit has a normalized cycle length. First address means is comprised of the counter 54 and the regulator 61 for generating a read address AD1 which successively increments at a rate corresponding to the specified pitch so as to read out the waveform data from the memory means. Voice means is comprised of the interpolator 64 and the cross-fade composer 66 for processing the read waveform data to generate the voice at the specified pitch Second address means is comprised of the virtual address counter 67 for generating a virtual address VA effective to freely contract and expand the time axis of the waveform data. Address control means is comprised of the waveform selector 55 operative when the read address AD1 deviates from the virtual address VA during the course of generation of the voice for controlling the first address means to change the read address AD1 by an integer multiple (ADS1) of the normalized cycle length so as to follow the virtual address.

Figure 10A:
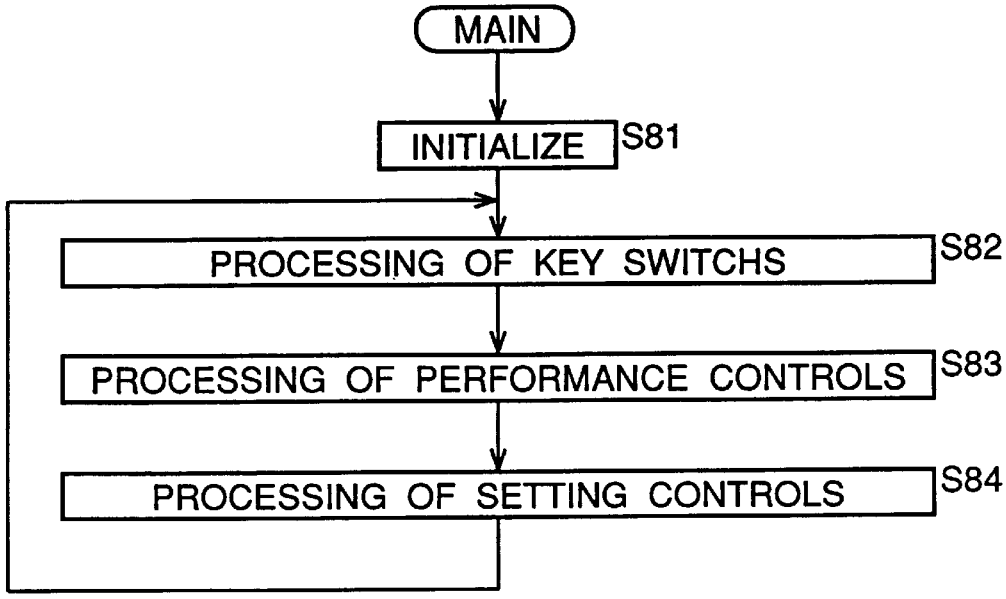
FIG. 10 (*a*) and FIG. 10 (*b*) are flowcharts for describing operation in which music tone generation is started in response to a note-on command in the music tone generating apparatus according to the invention.
Figure 10B:
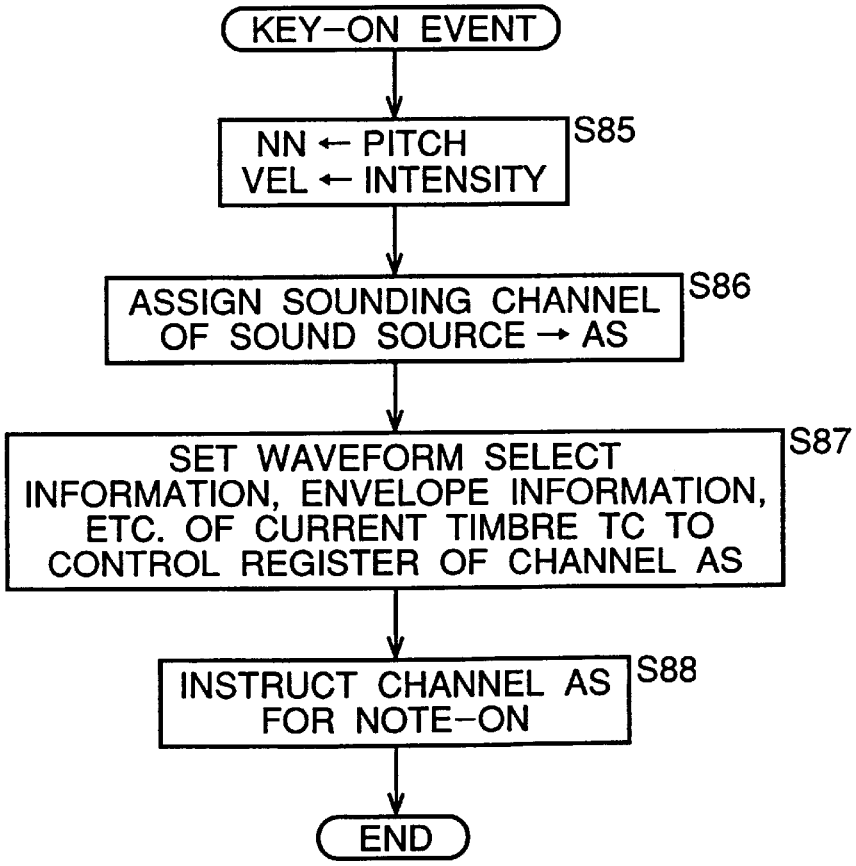

FIG. 10(*a*) and FIG. 10(*b*) are flowcharts for describing the basic operation in which the music tone generation is started in response to a note-on command in the music tone generating apparatus according to the invention. FIG. 10(*a*) is a main flowchart and FIG. 10(*b*) is a flowchart of a key-on event. Referring to FIG. 10 (*a*), the apparatus is first initialized in step S81. In step S82, processing associated with key switch operation is performed. In step S83, processing associated with performance control operation is performed. In step S84, processing associated with setting control operation is performed.

FIG. 10(*b*) describes the processing performed when a key-on event indicating sounding occurs in the key switch processing of step S82. First, in step S85, a pitch of a music tone designated by the pressed key is set to a register for a parameter NN, and key-pressing intensity or key operating velocity is set to another register for a parameter VEL. In step S86, a channel for serving this key-on event is assigned as a sounding channel AS. In step S87, waveform select information, envelope information and other information of a currently selected timbre TC are set to a control register of the sounding channel AS. To be more specific, the information to be set includes waveform storage position, attack length m, loop length n, level and rate of pitch corresponding to pitch NN, attack and sustain level and rate of envelope. In step S88, the sounding channel AS is instructed for note-on, upon which waveform reading and volume envelope control are performed.

In the above-mentioned control register setting at the time of note-on in step S87, if compression and expansion are not specified for the channel concerned, the operation to be performed after the note-on in the waveform generator is as follows. In the first step, using only the first series of the waveform, reading is started from top address A0 (refer to FIG. 4(*a*)) of the first unit or period 0 of the waveform data corresponding to the currently selected timbre TC among the plural pieces of waveform data stored in the waveform memory. CN1 of the first cycle number register 59 is 0. Next, in the second step, the reading is continued while updating the pointer p1 at a rate corresponding to the pitch. In the third step, when the pointer p1 has reached cycle length CL (in the example of FIG. 4(*a*), CL is a constant length), CN1 is incremented by one. The position pointed by the pointer p1 is back at start address 0 in response to the operation of the high-order bit masking block 71 in the regulator 61 shown in FIG. 8. Subsequently, the second step and the third step are repeated.

The virtual address counter 67 has a total of 15 bits; namely, 10 bits of integer part and 5 bits of fraction part in the scale of cycle number. According to the output value of this counter 67, the time-axis compression and expansion at the time of waveform reading is controlled. The number of bits of the integer part is selected to cover the maximum number of periods in one object waveform. The fraction part is provided to finely control the progression speed or VF (virtual F-number) of the virtual address. The virtual address counter 67 receives a loop address for specifying a range in which the same waveform units are repetitively read and a progression rate at which one object waveform is read, and outputs a virtual address to the waveform selector 55. The count value of the virtual address counter 67 progresses according to the progression of time or period. This count value is hereafter referred to as a virtual address VA.

For a first example, the above-mentioned virtual F-number VF is accumulated to generate the virtual address VA at a predetermined time interval (for example, every 10 msec, every 2 msec, or every 100 sampling periods). If this value has a fraction part, the amount to be incremented by one accumulating operation may be specified as 1.2 or 0.8 for example. The virtual F-number VF in this case provides the progression rate of the virtual address VA along the absolute time axis as reference. Therefore, if the waveform pitch is altered by changing the real F-number indicating the progression rate of the real read addresses, the reproduction time of the waveform data is not affected.

For a second example, every time one waveform unit is read, the virtual F-number VF is accumulated to the virtual address VA. The virtual F-number VF in this case determines a relative rate with reference to the progression rate (equivalent to the real F-number) of the real address at which the waveform data is read without time-axis compression and expansion. For example, if the relative progression rate determined by VF is 2, the virtual address progresses two times as fast as the real address, thereby halving the waveform reproduction time. In what follows, only the case in which the virtual address VA progresses along the time axis as with the above-mentioned first example will be described.

The virtual address starts from 0. As time passes, the virtual address increments to indicate the locus of positions at which waveform units are read from the waveform memory 63. The waveform selector 55 makes the cycle numbers CN1 and CN2 stored in the first and second cycle number registers 59 and 60 follow the cycle number indicated by this virtual address VA. Namely, the waveform selector 55 makes the read addresses of the two series follow the target cycle number specified by the virtual address. At the same time, the waveform selector 55 controls the cross-fade composer 66 to select one of the two series or to compose both series by cross-fading. To be more specific, the waveform selector 55 determines a difference between the virtual address VA provided from the virtual address counter 67 and the cycle number CN of the series currently faded in by the cross-fade block 66 or the series of which level is maintained at the maximum value (namely, the current series). Based on the determination, the waveform selector 55 determines whether to continue the reading of the waveform units in the current series or to switch to the other series to start reading of a different waveform unit belonging to the other series.

So far, the compression rate $\alpha'$ is read from the compression rate memory 58 according to the cycle number CN1 or CN2 of the current series, and pitch control is performed for the waveform units of the current series in which the reading is being made. Alternatively, as indicated with a dashed arrow extending from the virtual address counter 67 to the compression rate memory 58 shown in FIG. 8, the waveform data of the series being faded in by the cross-fade block 66 or the series of which level is maintained at the maximum value can be read at a pitch variation corresponding to the reading progression viewed from the whole waveform by reading the compression rate $\alpha'$ from the compression rate memory 58 by the integer part of the virtual address outputted from the virtual address counter 67.

In the control register setting upon the note-on event in step S87 shown in FIG. 10(*b*), if it is specified to perform compression and expansion in the channel concerned, the waveform generator 36 shown in FIG. 7 uses both of the first and second series. In detail, as shown in FIG. 8, while performing cross-fading in the cross-fade composer 66 as required, the waveform generator starts the sound source operation for compressing and expanding the time axis of the waveform read from the waveform memory 63. To be more specific, the waveform data is outputted from the waveform memory 63 by use of the read address (for example, AD1) of the first series. If the locus of the cycle number CN1 of this first series is sufficiently near to the locus of the virtual address VA, the reading of this first series is continued. On the other hand, if the locus of the cycle number CN1 of this first series goes away from the locus of the virtual address VA, switching of the reading is instructed. Then, in the other second series, the reading is started by use of the cycle number CN2 that is greater or smaller only in integer value than the CN1 and near the virtual address, upon which cross-fading from the first series to the second series is performed. After the cross-fading, waveform data is read at the read address (AD2) in the second series, and the difference between the locus of the cycle number CN2 of the second series and the virtual address VA is determined to maintain the above-mentioned tracking processing.

The following describes the operation to be performed by the waveform generator shown in FIG. 8 upon the note-on event of step S87 shown in FIG. 10(*b*). The counter 54 accumulates the real F-number in every sampling period with the initial value being 0, and outputs the result of the accumulation to the regulators 61 and 62 as the pointers p1 and p2. On the other hand, the virtual address counter 67 outputs the virtual address VA that temporally varies according to the virtual F-number VF with the initial value being 0. With cycle number CN1=0 as the initial value, the waveform selector 55 reads the first unit or period 0 of the waveform data corresponding to the timbre TC selected in the first series. For the memory format of the waveform data, refer to FIG. 4(*a*). At this moment, the interpolated sample value obtained by the first interpolator 64 corresponding to the first series is outputted from the cross-fade composer 66.

When the reading of the cycle number CN1=0 is finished, the cycle number CN1+1=1 to be read in the first series is set to the new cycle number CN1. The virtual address VA at that moment is compared with the new cycle number CN1=1 to check if the difference is ½ period or more. If the difference between the virtual address VA and the CN1=1 is found within ½ period, switching between the two series is not performed but, in still the first series, reading of periods corresponding to CN1=2, 3, and so on is performed to repeat the above-mentioned operation at the end of the successive periods.

On the other hand, if the virtual address VA advances relative to current CN1 by ½ period or more, or delays relative to current CN1 by ½ period or more, the switching between the two series is performed. The waveform selector 55 sets the cycle number corresponding to the virtual address VA to the CN2. Then the waveform selector 55 reads the period corresponding to the NC1 still in the first series, while start to read a new period corresponding to the above-mentioned CN2 in the second series. The waveform selector 55 controls the cross-fade composer 66 such that cross-fading is performed from the interpolated sample value of the first interpolator 64 corresponding to the first series to the interpolated sample value of the second interpolator 65 corresponding to the second series. This cross-fading is finished before the end of reading of the cycle number CN2 in the second series.

Then, when reading of the period CN2 ends in the faded-in period, the value of the CN2 is incremented by one. At this moment, the virtual address is compared with the CN2 to check if the difference is ½ period or more. The subsequent operation is the same as the operation performed after the determination in the first series. Namely, if switching between the two series is required, cross-fading to the first series is performed again; otherwise, the reading is continued in the second series. It should be noted that the criterion by which the switching is to be performed or not can be set to ⅝ period, 3 periods or else rather than the above-mentioned ½ period. Especially, likewise the periods CN1 and CN2 of the read address, the virtual address VA may be generated in terms of the cycle number of waveform units. In such a case, the comparison is held between the real cycle number and the virtual cycle number so that the generation and comparison of the virtual address can be performed easily by a small number of bits.

Generally, if no switching between the two series is performed, the current one of the two series (the series faded in immediately before by the cross-fade composer 66 or the series maintained at the maximum level) continues the reading of the period following the period read last, and this current series is outputted from the cross-fade composer 66 at the maximum level. If the switching is to be performed, the current series reads a next period following the period read last and the other series reads a new period to be switched corresponding to the virtual address VA, upon which cross-fading from the next unit of the current series to the new unit of the other series is conducted by the cross-fade composer 66.

Figure 11:
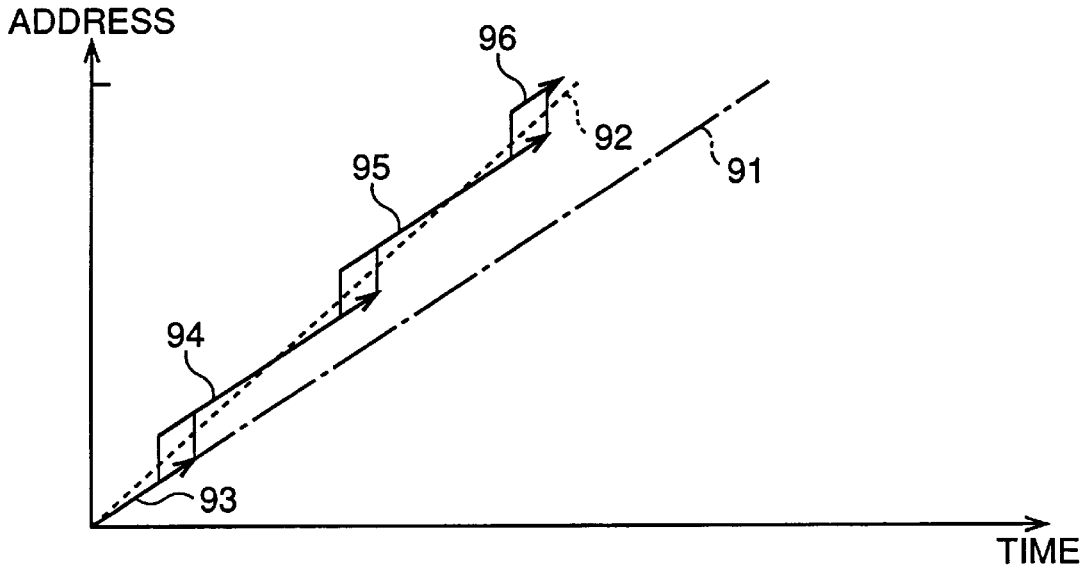
FIG. 11 is a diagram illustrating a first example of the music tone generation in which only a reproduction time of the music tone is compressed with a pitch of the music tone kept constant.

FIG. 11 through FIG. 17 show various examples as to how the read addresses in the first and second series progress in corresponding to the virtual address. FIG. 11 is a diagram illustrating a first example in which only the reproduction time of a music tone or voice is compressed with the pitch of the music tone kept constant. In the figure, reference numeral 91 denotes the read address of the first series outputted by the first regulator 61 when no compression or expansion is performed. Reference numeral 92 denotes the output of the virtual address counter 67. Reference numerals 93 and 95 denote the read addresses of the first series. Reference numerals 94 and 96 denote the read addresses of the second series. The horizontal axis represents time and the vertical axis represents the read address of the waveform memory 63. To compress the reproduction time, the output 92 of the virtual address counter is inclined greater than the read address 91 of the first series in which no compression or expansion is performed. To be more specific, the first series read from the waveform memory 63 by the read address 93 of the first series is outputted from the cross-fade composer 66. Then, the read address 93 of the first series delays behind the output 92 of the virtual address counter. When this delay has reached the predetermined number of periods, the waveform memory 63 is read by using the read address 94 of the second series, starting at the position reached by incrementing the address by the above-mentioned predetermined periods. This second series is outputted from the cross-fade composer 66. In doing so, the switching is not made instantaneously; rather, in a predetermined time interval before and after the switching, the ratio of the second series is gradually increased while using the outputs of the two series to thereby finally output the second series from the cross-fade composer 66.

Subsequently, the read address 94 of the second series is also delayed behind the output 92 of the virtual address counter. When this delay has reached the above-mentioned predetermined number of periods, the waveform memory 63 is read by use of the read address 95 of the first series, starting at the position determined by incrementing the current read address by the above-mentioned predetermined periods. This first series is outputted from the cross-fade composer 66. In the predetermined time interval before and after the switching, the ratio of the first series is also increased gradually while using the two series to thereby lastly output the first series from the cross-fade composer 66. Likewise, switching is made from the read address 95 of the first series to the read address 96 of the second series. Namely, the two series are alternated to track or follow the output 92 of the virtual address as the target value, and the read address is locally and intermittently skipped to read one whole waveform.

Figure 12:
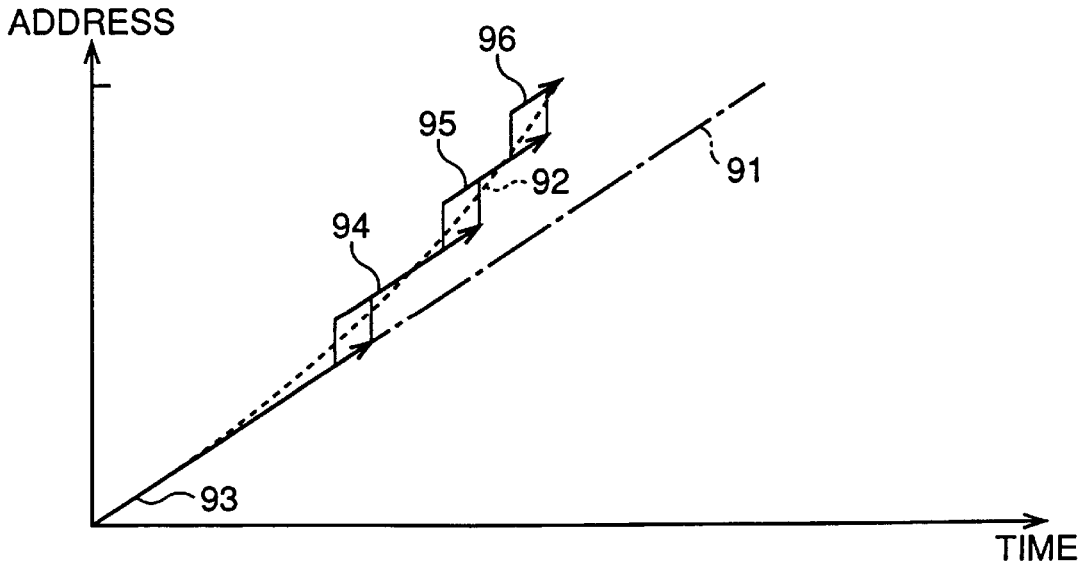
FIG. 12 is a diagram illustrating a second example of the music tone generation in which only the reproduction time is compressed with the pitch kept constant.

FIG. 12 is a diagram illustrating a second example in which only the reproduction time is compressed with the pitch kept constant. With reference to FIG. 12, components similar to those previously described with reference to FIG. 11 are denoted by the same reference numerals for simplicity. In the first example of FIG. 11, the output 92 of the virtual address counter is set linearly such that the time is uniformly compressed throughout the whole waveform. In the second example of FIG. 12, however, the output 92 is set in a curved manner such that the compression rate increases gradually. In this case, the two series are alternately switched to implement the compression likewise the first example of FIG. 11. In the predetermined time interval before and after the switching, the outputs of the two series are cross-faded to be outputted from the cross-fade composer 66. It should be noted that, instead of fixing to a certain value, the predetermined number of periods determining the critical delay may be set to a larger value as the compression rate increases, thereby adaptively controlling the compression.

Figure 13:
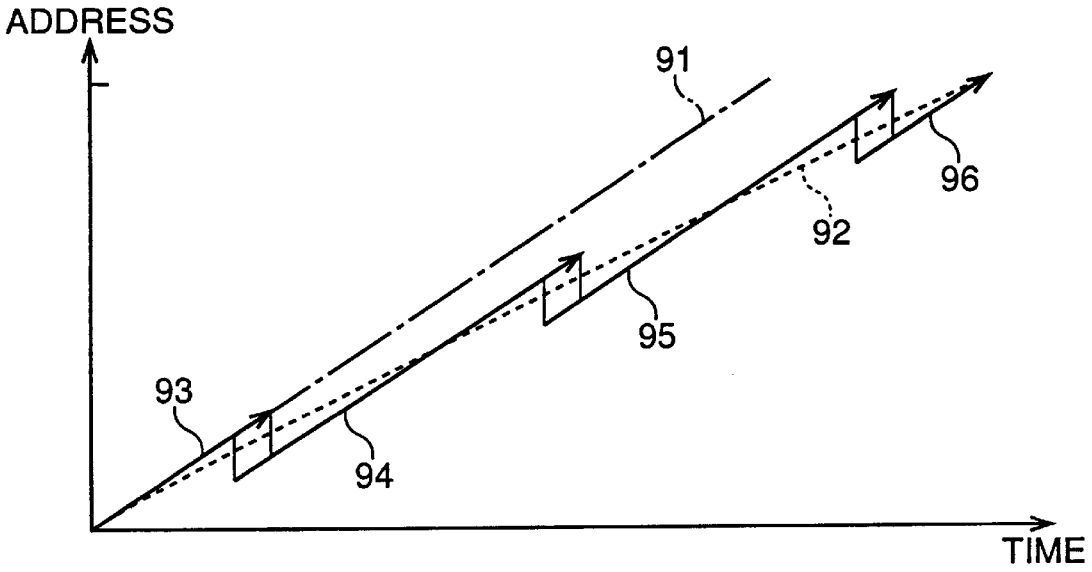
FIG. 13 is a diagram illustrating a third example of the music tone generation in which only the reproduction time is expanded with the pitch kept constant.

FIG. 13 is a diagram illustrating a third example in which only the reproduction time is expanded with the pitch kept constant. With reference to FIG. 13, the components similar to those previously described with reference to FIG. 11 are denoted by the same reference numerals for simplicity. To expand the reproduction time, the output 92 of the virtual address counter is declined below the tilt of the read address 91 of the first series for which no compression and expansion are made. To be more specific, the first series read from the waveform memory 63 by use of the read address 93 of the first series is outputted from the cross-fade composer 66. When the progression of the read address 93 of the first series has deviated by the predetermined number of periods from the output 92 of the virtual address counter, switching is made to the read address 94 of the second series and the waveform memory 63 is read from the position switched by delaying the address by the above-mentioned predetermined number of periods. This second series is outputted from the cross-fade composer 66. In the predetermined time interval before and after the switching, the outputs of the two series are cross-faded to be outputted from the cross-fade composer 66. Then, when the progression of the read address 94 of the second series has reached the above-mentioned predetermined number of periods from the output 92 of the virtual address counter, the waveform memory 63 is read from the position switched by delaying the address by the predetermined number of periods by use of the read address 95 of the first series again. Subsequently, the two series are alternately switched. Namely, the two series are alternately switched with the output 92 of the virtual address counter as the target value and the read address is locally repeated to read one object waveform.

Figure 14:
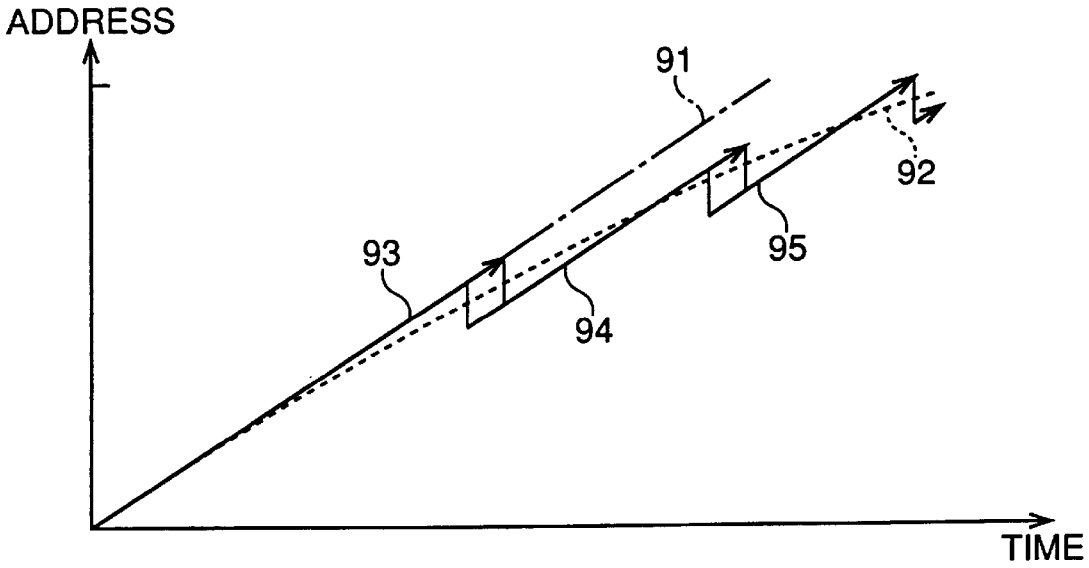
FIG. 14 is a diagram illustrating a fourth example of the music tone generation in which only the reproduction time is expanded with the pitch kept constant.

FIG. 14 is a diagram illustrating a fourth example in which only the reproduction time is expanded with the pitch kept constant. With reference to FIG. 14, components similar to those previously described with reference to FIG. 11 are denoted by the same reference numerals for simplicity. In the third example of FIG. 13, the output 92 of the virtual address counter is linearly set to expand the time uniformly throughout the whole waveform. In the fourth example of FIG. 14, the output 92 is set in a curved manner so that the compression rate lowers gradually. Namely, the expansion ratio increases. In this case, the expansion can be implemented in the same manner as described in the example of FIG. 13. It should be noted that, instead of fixing the predetermined number of periods for checking the degree of progression to a certain value, the predetermined number of periods may be set to a smaller value as the compression rate lowers, thereby adoptively controlling the expansion.

The real F-number corresponds to the pitch of a music tone to be generated. Therefore, the counter 54 increments the address pointer at a rate corresponding to this pitch. On the other hand, the virtual F-number VF of the virtual address VA may be freely set independently of music tone characteristics such as the music tone pitch. The virtual F-number VF may take not only a positive value but also a negative value. Also, the virtual F-number VF may be drastically varied halfway through the music tone generation. If the value of the virtual F-number VF is negative, the real address progresses in the positive direction of time while the reading of each period is cross-faded into the period located in the past along the time axis. When viewed as a whole, the read position looks progressing in the negative direction of time. If the virtual F-number VF is varied halfway through the music tone generation, compression and expansion can be performed on the waveform data in an interesting manner. For example, if a great virtual F-number VF is given to the address range of the attack portion of the waveform data and smaller progression speed is given subsequently, the waveform data with the attack portion compressed and the subsequent portions expanded is obtained.

Figure 15:
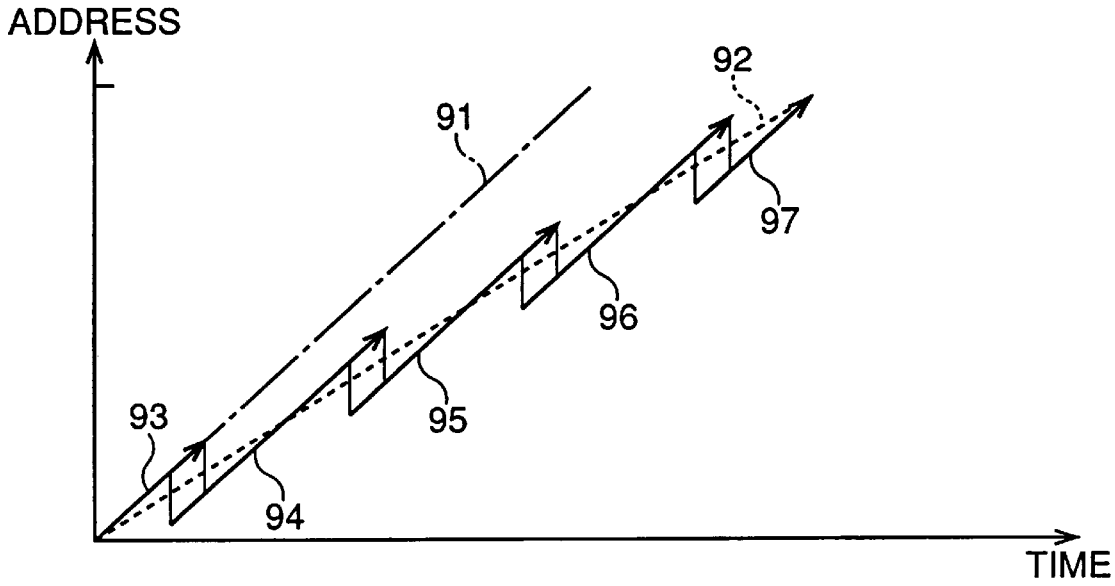
FIG. 15 is a diagram illustrating a fifth example of the music tone generation in which only the pitch is raised with the reproduction time kept constant.

FIG. 15 is a diagram illustrating a fifth example in which only the pitch is raised with the reproduction time kept constant. With reference to FIG. 15, components similar to those previously described with reference to FIG. 11 are denoted with the same reference numerals for simplicity. Reference numeral 97 denotes the read address of the first series to be outputted by the first regulator. To raise the pitch, the real F-number outputted from the F-number generator is raised to tilt the read address 91 of the first series for which no compression and expansion are performed greater than the tilt of the output 92 of the virtual address counter. To be more specific, the first series read from the waveform memory 63 by use of the read address 93 of the first series is outputted from the cross-fade composer 66. Then, the read address 93 of the first series advances relative to the output 92 of the virtual address counter. When this advance has reached the predetermined number of periods, switching is made to the read address 94 of the second series and the waveform memory 63 is read from the position switched by the above-mentioned predetermined number of periods, thereby outputting this second series from the cross-fade composer 66. In doing so, the switching is not made instantaneously; rather, in the predetermined time interval before and after the switching, the ratio of the second series is gradually increased while using both the outputs of the two series to finally output the second series from the cross-fade composer 66 after the switching.

Subsequently, the address 94 of the second series also advances relative to the output 92 of the virtual address counter. When this advance has reached the above-mentioned predetermined number of periods, switching is made to the read address 95 of the first series to read the waveform memory 63 from the position delayed by the above-mentioned predetermined number of periods. This first series is outputted from the cross-fade composer 66. At this moment, during the predetermined time interval before and after the switching, the ratio of the first series is gradually increased relative to the second series to thereby finally output the first series from the cross-fade composer 66. Likewise, switching is made from the read address 95 of the first series to the read address 96 of the second series and then to the read address 97 of the first series. In this case, the two series are alternately switched by use of the output 92 of the virtual address counter as the target value and the address pointer is locally repeated within each period of the waveform to read one object waveform.

Figure 16:
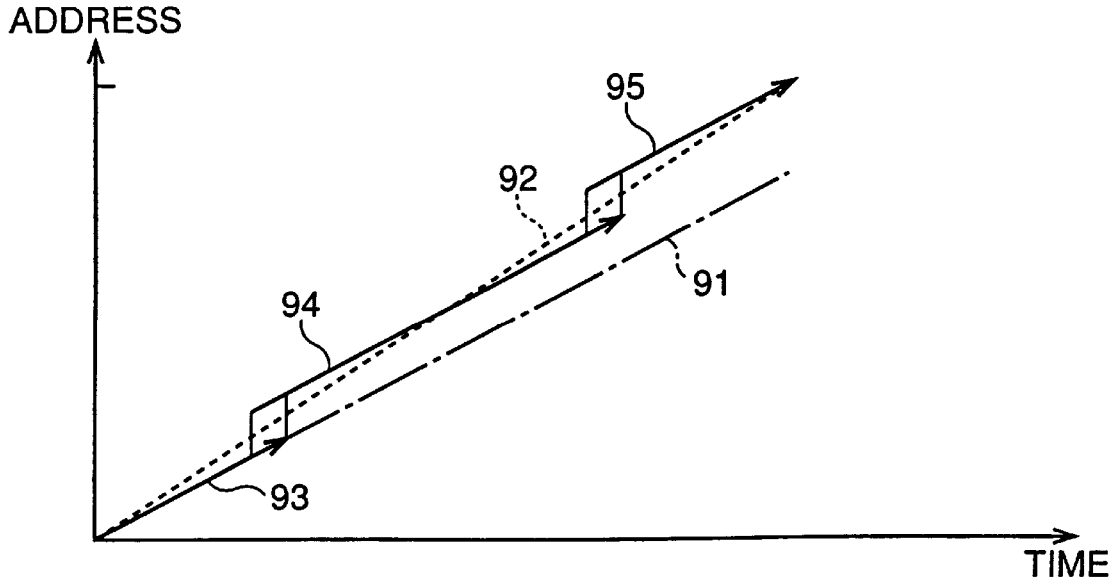
FIG. 16 is a diagram illustrating a sixth example of the music tone generation in which only the pitch is lowered with the reproduction time kept constant.

FIG. 16 is a diagram illustrating a sixth example in which only the pitch is lowered with the reproduction time kept constant. With reference to FIG. 16, components similar to those previously described with reference to FIG. 11 are denoted by the same reference numerals for simplicity. To lower the pitch, the real F-number outputted from the F-number generator is lowered. The read address 91 of the first series is tilted below the tilt of the output 92 of the virtual address counter with compression and expansion not performed. To be more specific, the first series read from the waveform memory 63 by use of the read address 93 of the first series is outputted from the cross-fade composer 66. The read address 93 of the first series delays behind the output 92 of the virtual address counter. When this delay has reached the predetermined number of periods, switching is made to the read address 94 of the second series to read the waveform memory 63 from the position delayed by the above-mentioned predetermined number of periods. This second series is outputted from the cross-fade composer 66. In the predetermined time interval before and after the switching, cross-fading is performed by use of the outputs of the two series to finally output the second series from the cross-fade composer 66. Subsequently, the two series are alternately switched according to the output 92 of the virtual address counter as the target value and the read address is locally skipped to read one object waveform.

As described with reference to FIGS. 15 and 16, even if the pitch of a music tone is altered, the profile of time variation of the virtual address VA is maintained unchanged to provide waveform data having the same time axis as the source waveform, with only the pitch altered. Because the time axis is compressed and expanded by use of the virtual address, the pitch can be altered with accuracy higher than that of conventional pitch changing methods.

Figure 17:
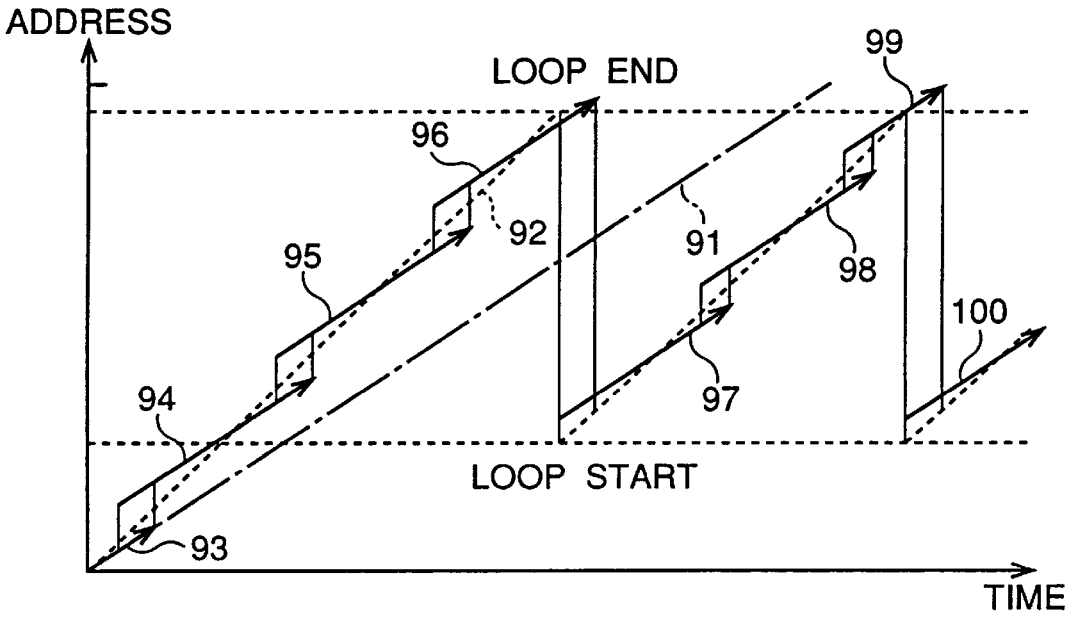
FIG. 17 is a diagram illustrating a seventh example of the music tone generation in which the compression and expansion are performed while looping virtual addresses.

In the examples described with reference to FIGS. 11 through 16, the virtual address is progressed continuously. It will be apparent that, after progressing to a predetermined value, the virtual address may jump to another value. FIG. 17 is a diagram illustrating a seventh example in which compression and expansion are performed while looping the virtual address. With reference to FIG. 17, components similar to those previously described with reference to FIG. 11 are denoted by the same reference numerals for simplicity. Reference numerals 98 and 100 denote read addresses of the second series to be outputted from the second regulator. Reference numeral 99 denotes a read address of the first series to be outputted from the first regulator. For example, the waveform data shown in FIG. 4(*b*) is prepared. There is a loop progression in the waveform data. When the virtual address VA reaches the address of a loop end LE, the progression returns to a loop start address LS. The loop start address LS and the loop end address LE can be specified only by their cycle numbers. In the example of FIG. 4(*b*), "m" may only be specified for the LS and "n" for the LE. Alternatively, "n" may be specified for the LE and "n-m" for the loop size. In the operation of loop progression, when the integer part of the sequentially progressing virtual address VA reaches LE=n, (VA−n +m) is calculated and the result is set to the virtual address VA as the loop return address. If loop progression is set to the virtual address, change is made such that only the virtual address counter 67 has the above-mentioned loop progression capability. If this change is made, the operations of the other blocks in the waveform generator 36 need not be changed in any particular manner. The waveform selector 55 receives the loop-progressing virtual address VA and compares the same with the period or cycle number CN of the current series to make the read address of the waveform data follow the virtual address in the same procedure as that mentioned above.

This is shown in FIG. 17. As in the first example of FIG. 11, the read addresses 93, 94, 95, and 96 of the first and second series are alternately switched and then the virtual address VA reaches the loop end LE=n. When the return is made to the loop start LS=m, switching is made from the read address 96 of the second series to the read address 97 of the first series to read the waveform memory 63 from the position switched by a predetermined number of periods from the virtual address VA. Subsequently, the read addresses 97, 98, 99, and 100 of the first and second series are alternately switched likewise. In a predetermined time interval before and after the switching, cross-fading is performed by use of the outputs of the two series. In the shown example, in considering the cross-fading, the cycle number of the loop end of the virtual address VA is set slightly before the last cycle number stored in the waveform memory. In the present preferred embodiment, only making the virtual address progress in a loop enables the loop-reading of a waveform while controlling compression and expansion of the time axis of the waveform, thereby implementing simple construction. On the contrary, controlling the loop by the read address of a waveform requires processing for detecting when the read address reaches the loop end address to return to the loop start address as well as processing for returning the virtual address to the loop start address.

In the description made with reference to FIGS. 15 through 17, the output 92 of the virtual address counter is altered linearly. It will be apparent that the output may be altered in non-linear manner. In the examples shown in FIGS. 11 through 16, the tilt of the read address 91 of the first and second series may also be altered in a nonlinear manner by altering the F-number outputted from the F-number generator 53 non-linearly relative to time.

In the above description, as shown in FIGS. 5 and 6, waveform data with the cycle length (the number of samples) of one waveform unit being different from bank to bank can be handled by the one common counter 54 shown in FIG. 8. Namely, high-order bit masking is performed in the first and second address regulators 61 and 62 shown in FIG. 8. Alternatively, the operation of the counter 54 may be controlled such that, when the predetermined last address corresponding to a bank has been detected, the counter returns to the start address.

In the above description, the cross-fading is always performed at switching between the two series. However, the cross-fading is not always necessary. The waveform units have phases set coincident with each other, so that joining the waveform units does not cause a large noise. Also, a compression period and an expansion period may be provided in one object waveform.

Further, not only waveform units discontinuous in one piece of waveform data may be joined with each other, but also waveform units may be joined between two different object waveforms. To do so, when joining an old waveform to a new waveform, the start address of the new waveform and the cycle number of a period to be joined may only be indicated to the sound source. For connecting two different waveforms, these waveforms are read such that they have the same frequency and are joined at the point of the same phase, thereby preventing a large noise from being caused at the joining.

As described above in conjunction with FIG. 10(*a*) to FIG. 17, the inventive method is carried out for generating a music tone or voice at a specified pitch while freely contracting and expanding the voice along a time axis by the following steps. Namely, the first step is performed for memorizing a voice in the form of waveform data composed of a sequence of waveform units arranged in cycles along the time axis. Each waveform unit has a normalized cycle length. The second step is performed for generating a read address which successively increments at a rate corresponding to the specified pitch so as to read out the memorized waveform data. The third step is performed for processing the read waveform data to generate the voice at the specified pitch. The fourth step is performed for generating a virtual address effective to freely contract and expand the time axis of the waveform data. The fifth step is performed for changing the read address by an integer multiple of the normalized cycle length so as to follow the virtual address when the read address deviates from the virtual address during the course of generation of the voice.

Specifically, the inventive method is carried by the steps of memorizing a voice in the form of waveform data composed of a sequence of waveform units arranged in cycles along the time axis, generating a read address which successively increments at a rate corresponding to the specified pitch so as to read out the memorized waveform data, the read address including a read cycle number which successively designates each waveform unit, processing the read waveform data to generate the voice at the specified pitch, generating a virtual address effective to freely contract and expand the time axis of the waveform data, the virtual address including a virtual cycle number which successively designates each waveform unit, and changing the read cycle number to keep in track with the virtual cycle number when the read cycle number deviates from the virtual cycle number during the course of generation of the voice.

Further specifically, the inventive method can be carried out by the steps of memorizing a voice in the form of waveform data composed of a sequence of waveform units arranged in cycles along the time axis, generating a read address which successively increments at a rate corresponding to the specified pitch so as to read out the memorized waveform data, the read address normally being a continuous read address which successively designates each waveform unit, processing the read waveform data to generate the voice at the specified pitch, generating a virtual address effective to freely contract and expand the time axis of the waveform data, the virtual address including a continuous virtual address which successively designates each waveform unit and occasionally including a discontinuous virtual address which designates jump from one waveform unit to another waveform unit, and discontinuously changing the continuous read address in response to the discontinuous virtual address so as to keep in track with the virtual address during the course of generation of the voice.

Additionally, the present invention covers the machine readable medium 42 shown in FIG. 7 for use in the voicing apparatus having the CPU in the controller 33 shown in FIG. 7 for generating a voice at a specified pitch while freely contracting and expanding the voice along a time axis. The machine readable medium 42 contains program instructions executable by the CPU for causing the voicing apparatus to perform the steps as described above. Typically, the steps include memorizing a voice in the form of waveform data composed of a sequence of waveform units arranged in cycles along the time axis, generating a read address which successively increments at a rate corresponding to the specified pitch so as to read out the memorized waveform data, processing the read waveform data to generate the voice at the specified pitch, generating a virtual address effective to freely contract and expand the time axis of the waveform data, and changing the read address by an integer multiple of the normalized cycle length so as to follow the virtual address when the read address deviates from the virtual address during the course of generation of the voice.

Figure 18:
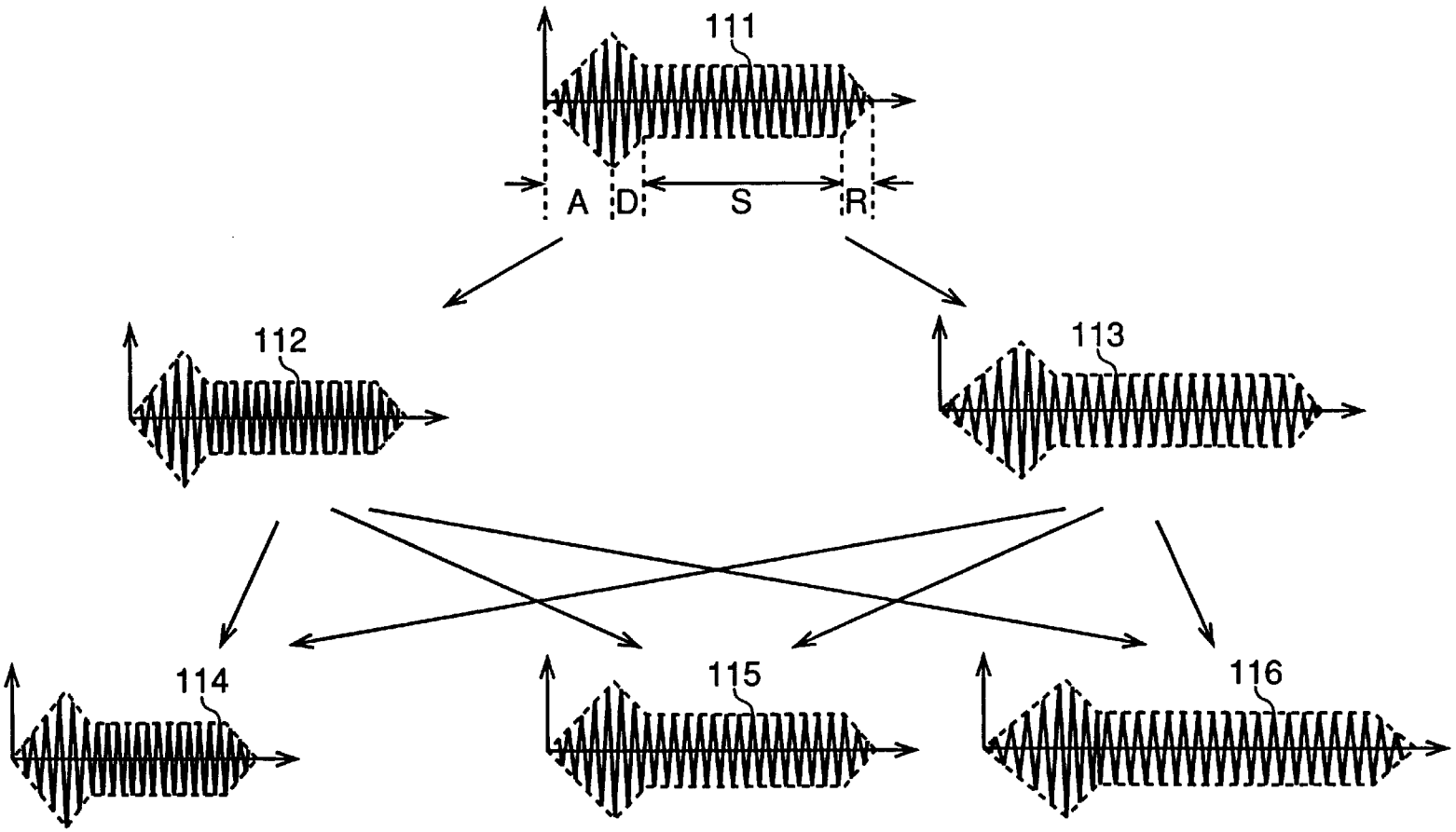
FIG. 18 is a diagram illustrating a first specific example in which a shape of waveform is controlled for reproduction in the music tone generating apparatus according to the invention.
Figure 19:
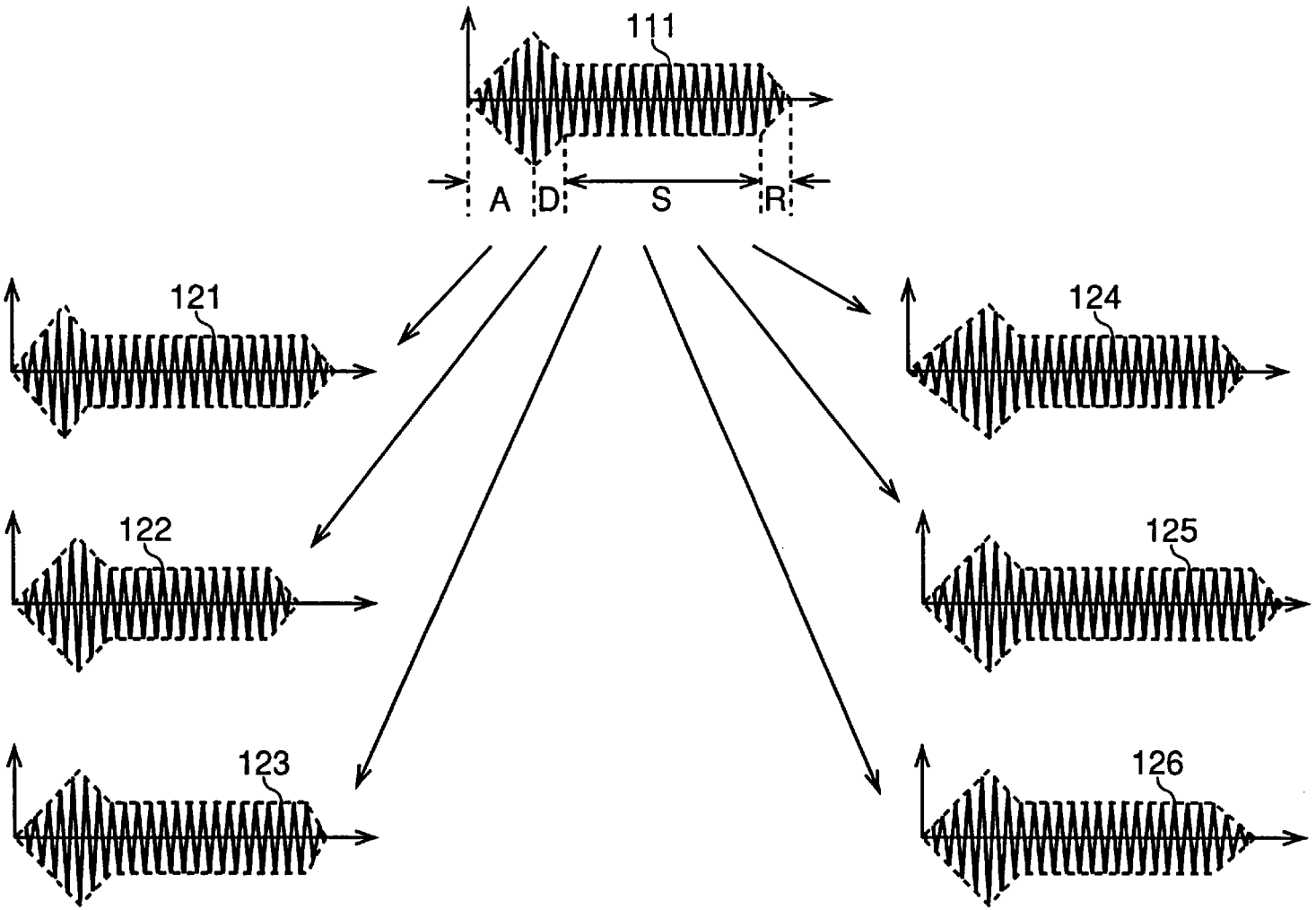
FIG. 19 is a diagram illustrating a second specific example in which a shape of waveform is controlled for reproduction in the music tone generating apparatus according to the invention.

The following describes specific examples in which the shape of an object waveform stored in the wave memory is modified in the voice reproduction with reference to FIGS. 18 and 19. FIG. 18 is a diagram illustrating a first specific example in which the shape of the waveform is controlled for the voice reproduction in the voicing apparatus according to the invention. In the example, one object waveform is expanded and compressed. In the figure, reference numeral 111 denotes a source waveform, reference numeral 112 denotes a pitch-up waveform, reference numeral 113 denotes a pitch-down waveform, reference numeral 114 denotes a compressed waveform, reference numeral 115 denotes an isometric waveform, and reference numeral 116 denotes an expanded waveform. The horizontal axis represents time while the vertical axis represents amplitude. Each of these waveforms is schematically divided in attack section A, decay section D, sustain section S, and release section R from the left to the right of one music tone waveform.

The pitch-up waveform 112 is obtained by increasing the real F-number when reading the waveform from the waveform memory to raise the reading rate for higher pitch. In the period in which one waveform unit is generated, the same is compressed according to the pitch. The pitch-down waveform 113 is obtained by decreasing the F-number to lower the reading rate for lower pitch. In the period in which one waveform unit is generated, the same is expanded.

The compressed waveform 114 is obtained by manipulating one of the pitch-up waveform 112 and the pitch-down waveform 113 to compress the time of generating one waveform more than the source waveform 111 without altering the pitch of the waveform. The isometric waveform 115 is obtained by manipulating one of the pitch-up waveform 112 and the pitch-down waveform 113 to restore the waveform generating time with the same length as that of the source waveform 111 without altering pitch of the waveform. This waveform may also be reproduced by reading with the same pitch as that of the source waveform 111. The expanded waveform 116 is obtained by manipulating one of the pitch-up waveform 112 and the pitch-down waveform 113 to expand the time in which one waveform is generated more than the source waveform 111 without altering the pitch of the waveform.

FIG. 19 is a diagram illustrating a second specific example in which a shape of waveform is controlled for reproduction in the music tone generating apparatus according to the invention. In this example, one waveform is partially expanded and compressed. In the figure, reference numeral 111 denotes the same waveform as the source waveform shown in FIG. 18, reference numeral 121 denotes a waveform of which top portion is compressed, reference numeral 122 denotes a waveform of which sustain portion is compressed, reference numeral 123 denotes a waveform of which release portion is compressed, reference numeral 124 denotes a waveform of which top portion is expanded, reference numeral 125 is a waveform of which sustain portion is expanded, and reference numeral 126 denotes a waveform of which release portion is expanded. As with FIG. 18, one waveform is schematically shown in FIG. 19. The top portion of the waveform includes the attack section and the decay section described in conjunction with FIG. 18. The sustain portion is the above-mentioned sustain section. The release portion is the above-mentioned release section. The waveform 121 having the top portion compressed, the waveform 122 having the sustain portion compressed, and the waveform 123 having the release portion compressed are obtained by compressing the corresponding sections of the source waveform 111. The waveform 124 having the top portion expanded, the waveform 125 having the sustain portion expanded, and the waveform 126 having the release portion expanded are obtained by expanding the corresponding sections of the source waveform 111. In the example of FIG. 19, the pitch of the read waveform is the same as the pitch of the source waveform. It will be apparent that the pitch may be altered. As described, according to the music tone generating apparatus associated with the present invention, not only the pitch of the source waveform 111 can be altered but also one entire waveform or a portion thereof can be compressed or expanded along time axis regardless of the pitch of the waveform. It should be noted that, in FIGS. 18 and 19, the overall waveform shape is maintained if the pitch of the waveform data is altered but the time-variant profile of the virtual address VA is not altered. This overall waveform shape does not denote an envelope of volume of the music tone. The overall waveform shape can also be observed in the waveform data which is processed for making constant the volume envelope at the stage of waveform preparation.

In the above description, the compression and expansion of time axis are controlled by generating the virtual address. It will be apparent that the virtual address need not be generated if the difference between the virtual address and the read address can be obtained. Such differential information is substantially equivalent to the virtual address too, and is also included in the technological scope of the present invention. This is because this differential information is obtained by subtracting the read address from the virtual address, and therefore adding this differential information to the read address makes the virtual address.

In the above description, the waveform data is read from the waveform memory 63 by use of the start addresses ADS1 and ADS2 and the read pointers p1 and p2. It will be apparent that the start address A0 of the waveform shown in FIG. 4(*a*) or 4(*b*) can be maintained without change, while the number of bits of the pointers p1 and p2 can be increased to sequentially read two or more pieces of the waveform units and to switch the read addresses between the pair of series by use of the pointers p1 and p2.

In the above description, the cycle lengths of waveform units are normalized. It will be apparent that waveform units in which a start address is stored beforehand may only be attached with a number identifying these waveform units without normalizing cycle lengths. Detection of the deviation from the virtual address based on the identification number of the waveform units read by the read address generator simplifies the processing for determining the difference between the read address and the virtual address, thereby facilitating the control processing. At this moment, the compression rate $\alpha'$ is stored in the compression rate memory beforehand in correspondence to the waveform unit identified by that number. The cycle length of an waveform unit can be obtained from the difference between the start address of the subsequently adjacent waveform unit and the start address of the current waveform unit for example. The cycle lengths of waveform units may also be stored provisionally.

The entire compression and expansion of a waveform described with reference to FIG. 18, the partial compression and expansion of a waveform described with reference to FIG. 19, and the various compression and expansion illustrated in FIGS. 11 through 17 can be selectively used by all parameters associated with music tone control by appropriately performing the setting processing of step S87 shown in FIG. 10, thereby controlling the time-axis expansion and compression. For example, the time-axis expansion and compression can be controlled according to a selected timbre or the pitch and intensity specified in performance information. In addition, the time-axis expansion and compression can be controlled by volume, tempo, rhythm type, effect type, various envelopes, performance timing, chord type, note, and so on.

In the above description, the source waveform represents a music tone generated by an acoustic musical instrument. It will be apparent that the source waveform may be of any tones or voices that include a periodic component such as a music tone generated by an electronic musical instrument and a human voice. These tones having a periodic component are generically referred to as music tones herein.

The compression rate $\alpha'$ is not necessarily set accurately by measurement. The compression rate $\alpha'$ may be manipulated as desired before setting. Instead of using the compression rate $\alpha'$, a waveform having a time-variant characteristic approximating the compression rate $\alpha'$ may be generated by a pitch envelope generator for example. To be more specific, methods are available in which such a waveform can be approximated as a folded line envelope. Otherwise, an envelope can be generated by reading a memory storing envelope samples having temporally different sampling intervals. In this case, capturing the above-mentioned off-pitch waveform component into the parameters of the envelope generator simplifies the constitution of the apparatus.

As described above and according to the invention, compression and expansion of the time axis of waveform data can be controlled as desired independently from the pitch of the music tone. Even halfway through reading of the waveform data, the compression rate $\alpha$ long the time axis can be controlled finely. In addition, plural pieces of partial waveform data can be joined to each other smoothly.

While the preferred embodiments of the present invention have been described using specific terms, such description is for illustrative purposes only, and it is to be understood that changes and variations may be made without departing from the spirit or scope of the appended claims.

What is claimed is:

1. A music apparatus for generating a music tone at a specified pitch while freely contracting and expanding the music tone along a time axis, the music apparatus comprising:

a waveform memory that memorizes a music tone in the form of waveform data composed of a sequence of waveform units arranged in cycles along the time axis, each waveform unit having a normalized cycle length;

a read address generator that generates a read address which successively increments at a rate corresponding to the specified pitch, thereby reading out the waveform data from the waveform memory according to the read address;

a tone generator that processes the read waveform data to generate the music tone at the specified pitch;

a virtual address generator that generates a virtual address effective to freely contract and expand the time axis of the waveform data; and an address controller that operates when the read address deviates from the virtual address during the course of generation of the music tone for controlling the read address generator to change the read address by an integer multiple of the normalized cycle length so as to track the virtual address.

2. A music apparatus according to claim 1, further comprising a compression rate memory that memorizes a compression rate by which each waveform unit is compressed to normalize a cycle length of each waveform unit, and wherein the read address generator adjusts the rate of the read address according to the compression rate memorized in the compression rate memory.

3. A music apparatus according to claim 1, wherein the read address generator comprises a counter that operates based on the pitch of the music tone for successively outputting a pointer effective to regulate a phase of each waveform unit to be read out, and a regulator that processes the pointer according to a different normalized cycle length of each waveform unit for generating the read address so that each waveform unit can be read out in the same phase without regard to the different normalized cycle length.

4. A music apparatus according to claim 1, wherein each waveform unit contains sample values in number of $2^x$ where X is determined according to the normalized cycle length, and wherein the read address generator comprises a counter that counts a binary number represented by Y bits so as to generate the read address where Y is not less than X, and a detector that detects an end point of reading of each waveform unit when the counter carries the binary number at bit X.

5. A music apparatus according to claim 4, wherein the counter operates based on the pitch of the music tone for successively outputting a pointer effective to regulate a phase of each waveform unit to be read out, and wherein the read address generator further comprises a regulator that processes the pointer according to a different normalized cycle length of each waveform unit for generating the read address so that each waveform unit can be read out in the same phase without regard to the different normalized cycle length.

6. A music apparatus according to claim 1, wherein the read address generator generates a read address including a read cycle number which successively designates each waveform unit, wherein the virtual address generator generates a virtual address including a virtual cycle number which successively designates each waveform unit, and wherein the address controller operates when the read cycle number deviates from the virtual cycle number during the course of generation of the music tone for controlling the read address generator to change the read cycle number so as to track the virtual cycle number.

7. A music apparatus according to claim 6, wherein the address controller operates when a cycle number difference between the read cycle number and the virtual cycle number exceeds a predetermined value during the course of generation of the music tone for controlling the read address generator to change the read cycle number so as to reduce the cycle number difference below the predetermined value.

8. A music apparatus according to claim 6, wherein the read address generator normally generates a continuous read cycle number which successively designates each waveform unit, wherein the virtual address generator occasionally generates a discontinuous virtual cycle number which designates jump from one waveform unit to another waveform unit, and wherein the address controller operates in response to the discontinuous virtual cycle number for controlling the read address generator to discontinuously change the continuous read cycle number so as to track the virtual cycle number.

9. A music apparatus according to claim 8, wherein the virtual address generator normally generates a continuous virtual cycle number during loop cycles between a loop start cycle and a loop end cycle, and occasionally generates a discontinuous virtual cycle number which designates jump from the loop end cycle to the loop start cycle.

10. A music apparatus according to claim 1, further comprising a sampler that provides waveform data by digital sampling of a music tone, an analyzer that analyzes the waveform data to determine a cycle length of each waveform unit contained in the waveform data, and a normalizer that selectively compresses and expands each waveform unit to normalize the cycle length.

11. A music apparatus for generating a music tone at a specified pitch while freely contracting and expanding the music tone along a time axis, the music apparatus comprising:

a waveform memory that memorizes a music tone in the form of waveform data composed of a sequence of waveform units arranged in cycles along the time axis;

a read address generator that generates a read address which successively increments at a rate corresponding to the specified pitch so as to read out the waveform data from the waveform memory, the read address including a read cycle number which successively designates each waveform unit;

a tone generator that processes the read waveform data to generate the music tone at the specified pitch;

a virtual address generator that generates a virtual address effective to freely contract and expand the time axis of the waveform data, the virtual address including a virtual cycle number which successively designates each waveform unit; and an address controller that operates when the read cycle number deviates from the virtual cycle number during the course of generation of the music tone for controlling the read address generator to change the read cycle number so as to track the virtual cycle number.

12. A music apparatus for generating a music tone at a specified pitch while freely contracting and expanding the music tone along a time axis, the music apparatus comprising:

a waveform memory that memorizes a music tone in the form of waveform data composed of a sequence of waveform units arranged in cycles along the time axis;

a read address generator that generates a read address which successively increments at a rate corresponding to the specified pitch so as to read out each waveform unit from the waveform memory, and that normally generates a continuous read cycle number which successively designates each waveform unit;

a tone generator that processes the read waveform data to generate the music tone at the specified pitch;

a virtual address generator that generates a virtual address effective to freely contract and expand the time axis of the waveform data, the virtual address including a continuous virtual cycle number which successively designates each waveform unit and occasionally including a discontinuous virtual cycle number which designates jump from one waveform unit to another waveform unit; and an address controller that operates in response to the discontinuous virtual cycle number for controlling the read address generator to discontinuously change the continues read cycle number so as to track the virtual cycle number.

13. A music apparatus according to claim 12, wherein the virtual address generator normally generates a continuous virtual cycle number during loop cycles between a loop start cycle and a loop end cycle, and occasionally generates a discontinuous virtual cycle number which designates jump from the loop end cycle to the loop start cycle.

14. A voicing apparatus for generating a voice at a specified pitch while freely contracting and expanding the voice along a time axis, the voicing apparatus comprising:

memory means for memorizing a voice in the form of waveform data composed of a sequence of waveform units arranged in cycles along the time axis, each waveform unit having a normalized cycle length;

first address means for generating a read address which successively increments at a rate corresponding to the specified pitch so as to read out the waveform data from the memory means;

voice means for processing the read waveform data to generate the voice at the specified pitch;

second address means for generating a virtual address effective to freely contract and expand the time axis of the waveform data; and address control means operative when the read address deviates from the virtual address during the course of generation of the voice for controlling the first address means to change the read address by an integer multiple of the normalized cycle length so as to follow the virtual address.

15. A voicing apparatus for generating a voice at a specified pitch while freely contracting and expanding the voice along a time axis, the voicing apparatus comprising:

memory means for memorizing a voice in the form of waveform data composed of a sequence of waveform units arranged in cycles along the time axis;

first address means for generating a read address which successively increments at a rate corresponding to the specified pitch so as to read out the waveform data from the memory means, the read address including a read cycle number which successively designates each waveform unit;

voice means for processing the read waveform data to generate the voice at the specified pitch;

second address means for generating a virtual address effective to freely contract and expand the time axis of the waveform data, the virtual address including a virtual cycle number which successively designates each waveform unit; and address control means operative when the read cycle number deviates from the virtual cycle number during the course of generation of the voice for controlling the first address means to change the read cycle number so as to follow the virtual cycle number.

16. A voicing apparatus for generating a voice at a specified pitch while freely contracting and expanding the voice along a time axis, the voicing apparatus comprising:

memory means for memorizing a voice in the form of waveform data composed of a sequence of waveform units arranged in cycles along the time axis;

first address means for generating a read address which successively increments at a rate corresponding to the specified pitch so as to read out each waveform unit from the memory means, the first address means normally generating a continuous read address which successively designates each waveform unit;

voice means for processing the read waveform data to generate the voice at the specified pitch;

second address means for generating a virtual address effective to freely contract and expand the time axis of the waveform data, the second address means generating a continuous virtual address which successively designates each waveform unit and occasionally generating a discontinuous virtual address which designates jump from one waveform unit to another waveform unit; and address control means operative in response to the discontinuous virtual address for controlling the first address means to discontinuously change the continuous read address so as to keep in track with the virtual address.

17. A method of generating a voice at a specified pitch while freely contracting and expanding the voice along a time axis, the method comprising the steps of:

memorizing a voice in the form of waveform data composed of a sequence of waveform units arranged in cycles along the time axis, each waveform unit having a normalized cycle length;

generating a read address which successively increments at a rate corresponding to the specified pitch so as to read out the memorized waveform data;

processing the read waveform data to generate the voice at the specified pitch;

generating a virtual address effective to freely contract and expand the time axis of the waveform data; and changing the read address by an integer multiple of the normalized cycle length so as to follow the virtual address when the read address deviates from the virtual address during the course of generation of the voice.

18. A method of generating a voice at a specified pitch while freely contracting and expanding the voice along a time axis, the method comprising the steps of:

memorizing a voice in the form of waveform data composed of a sequence of waveform units arranged in cycles along the time axis;

generating a read address which successively increments at a rate corresponding to the specified pitch so as to read out the memorized waveform data, the read address including a read cycle number which successively designates each waveform unit;

processing the read waveform data to generate the voice at the specified pitch;

generating a virtual address effective to freely contract and expand the time axis of the waveform data, the virtual address including a virtual cycle number which successively designates each waveform unit; and changing the read cycle number to keep in track with the virtual cycle number when the read cycle number deviates from the virtual cycle number during the course of generation of the voice.

19. A method of generating a voice at a specified pitch while freely contracting and expanding the voice along a time axis, the method comprising the steps of:

memorizing a voice in the form of waveform data composed of a sequence of waveform units arranged in cycles along the time axis;

generating a read address which successively increments at a rate corresponding to the specified pitch so as to read out the memorized waveform data, the read address normally being a continuous read address which successively designates each waveform unit;

processing the read waveform data to generate the voice at the specified pitch;

generating a virtual address effective to freely contract and expand the time axis of the waveform data, the virtual address including a continuous virtual address which successively designates each waveform unit and occasionally including a discontinuous virtual address which designates jump from one waveform unit to another waveform unit; and discontinuously changing the continues read address in response to the discontinuous virtual address so as to keep in track with the virtual address during the course of generation of the voice.

20. A machine readable medium for use in a voicing apparatus having a CPU for generating a voice at a specified pitch while freely contracting and expanding the voice along a time axis, the medium containing program instructions executable by the CPU for causing the voicing apparatus to perform the steps of:

memorizing a voice in the form of waveform data composed of a sequence of waveform units arranged in cycles along the time axis, each waveform unit having a normalized cycle length;

generating a read address which successively increments at a rate corresponding to the specified pitch so as to read out the memorized waveform data;

processing the read waveform data to generate the voice at the specified pitch;

generating a virtual address effective to freely contract and expand the time axis of the waveform data; and changing the read address by an integer multiple of the normalized cycle length so as to follow the virtual address when the read address deviates from the virtual address during the course of generation of the voice.

21. A machine readable medium for use in a voicing apparatus having a CPU for generating a voice at a specified pitch while freely contracting and expanding the voice along a time axis, the medium containing program instructions executable by the CPU for causing the voicing apparatus to perform the steps of:

memorizing a voice in the form of waveform data composed of a sequence of waveform units arranged in cycles along the time axis;

generating a read address which successively increments at a rate corresponding to the specified pitch so as to read out the memorized waveform data, the read address including a read cycle number which successively designates each waveform unit;

processing the read waveform data to generate the voice at the specified pitch;

generating a virtual address effective to freely contract and expand the time axis of the waveform data, the virtual address including a virtual cycle number which successively designates each waveform unit; and changing the read cycle number to keep in track with the virtual cycle number when the read cycle number deviates from the virtual cycle number during the course of generation of the voice.

22. A machine readable medium for use in a voicing apparatus having a CPU for generating a voice at a specified pitch while freely contracting and expanding the voice along a time axis, the medium containing program instructions executable by the CPU for causing the voicing apparatus to perform the steps of:

memorizing a voice in the form of waveform data composed of a sequence of waveform units arranged in cycles along the time axis;

generating a read address which successively increments at a rate corresponding to the specified pitch so as to read out the memorized waveform data, the read address normally being a continuous read address which successively designates each waveform unit;

processing the read waveform data to generate the voice at the specified pitch;

generating a virtual address effective to freely contract and expand the time axis of the waveform data, the virtual address including a continuous virtual address which successively designates each waveform unit and occasionally including a discontinuous virtual address which designates jump from one waveform unit to another waveform unit; and discontinuously changing the continuous read address in response to the discontinuous virtual address so as to keep in track with the virtual address during the course of generation of the voice.

23. An apparatus for reproducing waveform data of a tone comprising:

a memory that memorixzes waveform data whcih represents a series of waveform values of a tone arranged sequentially along a time axis;

an input section that inputs information which indicates contraction or expansion of the time axis during the course of reproduction of the waveform data; and a reproducing section that sequentially extracts blocks of the waveform values from the series of the waveform values in a reverse direction of the time axis from present to past, the reproducing section being operative when the inputted information indicates the contraction for rearranging the series of the waveform values by thinning out waveform values other than those contained in the extracted bloks so as to reproduce the waveform data, otherwise being operative when the inputted information indicates the expansion for rearranging the series of the waveform values by duplicating a part of the waveform value contained in the extracted blocks so as to reproduce the waveform data.

24. An apparatus reproducing waveform data of a tone comprising:

a memory that memorizes waveform data which represents a series of a waveform values of a tone arranged sequentially along a time axis;

an input section that inputs information which indicates contraction or expansion of the time axis during the course of reproduction of the waveform data;

a pointer section that sequentially points to positions of the waveform values along the time axis in a reverse direction from present to past at a rate corresponding to a degree of the contraction or expansion indicated by the inputted information; and a reproducing section for sequentially extracting blocks of the waveform values from the series of the waveform values based on the sequentially pointed positions so as to reproduce the waveform data, the reproduce the waveform data, the reproducing secton being operative if the position does not yet reach a next block for repeating a part of a current block until the position advances to the next block.

25. An apparatus for reproducing waveform, data of a tone comprising:

a memory that memorizes waveform data which represents a series of waveform values of a tone arranged sequentially along a time axis;

an input section that inputs information which indicates contraction or expansion of the time axis during the course of reproduction of the waveform data; and a reproducing section that sequentially extracts blocks of the waveform values from the series of the waveform values in a reverse direction of the time axis from present to past, each block having a length determined according to a degree of the contraction or extractin indicated by the inputted information, the reproducing section rearranging the extracted blocks so as to reproduce the waveform data.

26. An apparatus for reproducing waveform data of tones comprising:

a memory that memorizes waveform data which represents a eries of waveform values of tones arranged sequentially along a time axis;

an input section that inputs information which indicates contraction or expansion of the time axis during the course of reproduction of the waveform data;

a pointer section that sequentially points to positions of the waveform values along the time axis in a reverse direction from present to past at a rate corresponding to a degree of the contraction or expansion indicated by the inputted information; and a reproducing section that sequentially extracts blocks of the waveform values from the series of the waveform values based on the sequentially pointed positions, and rearranging the blocks so as to reproduce the waveform data.

27. A method of reproducing waveform data of a tone comprising the steps of:

providing waveform data that represents a series of waveform values of a tone arranged sequentially along a time axis;

inputting information that indicates contraction or expansion of the time axis during the corse of reproduction of the waveform data;

sequentially extracting blocks of the waveform values from the series of the waveform values in a reverse direction of the time axis from present to past;

rearranging the series of the waveform values by thinning out waveform values other than those contained in the extracted blocks so as to reproduce the waveform data when the inputted information indiates the contraction; and otherwise rearranging the series of the waveform values by duplicating a part of the waveform values contained in the extracted blocks so as to reproduce the waveform data when the inputted information indicates the expansion.

28. A method of reproducing waveform data of a tone comprising the steps of:

providing waveform data that represents a series of a waveform values of a tone arranged sequentially along a time axis;

inputting information that indicates contraction or expansion of the time axis during the course of reproduction of the waveform data;

sequentially pointing to positions of the waveform values along the time axis in a reverse direction from present to past at a rate corresponding to a degree of the contraction or expansion indicated by the inputted information; sequentially extracting blocks of the waveform values from the series of the waveform values based on the sequentially pointed positions so as to reproduce the waveform data; and repeating a part of a current block until the position advances to a next block if the position does not yet reach the next block.

29. A method of reproducing waveform data of a tone comprising the steps of:

providing waveform data that represents a series of waveform values of a tone arranged sequentially along a time axis;

inputting information that indicates contraction or expansion of the time axis during the course or reproduction of the waveform data;

sequentially extracting blocks of the waveform values from the series of the waveform values in a reverse direction of the time axis from present to past such that each block has a length determined according to a degree of the contraction or extraction indicated by the inputted information; and rearranging the extracted blocks so as to reproduce the waveform data.

30. A method of reproducing waveform data of tones comprising the steps of:

providing waveform data that represents a series of waveform, values of tones arranged sequentially along a time axis;

inputting information that indicates contraction or expansion of the time axis during the course of reproduction of the waveform data;

sequentially pointing to positions of the waveform values along the time axis in a reverse direction from present to past at a rate corresponding to a degree of the contraction or expansion idicated by the inputted information;

sequentially extracting blocks of the waveform values from the series of the waveform values based on the sequentially pointed positions; and rearranging the blocks so as to reproduce the waveform data.

31. A machine-readable medium for use in a music apparatus having a central processing unit, the medium containing program instructions executable by the central processing unit for causing the music apparatus to perform a process of reproducing waveform data of a tone, wherein the process comprises the steps of:

loading waveform data that represents a series of waveform values of a tone arraned sequentially along a time axis;

inputting information that indicates contraction or expansion of the time axis during the course of reproduction of the waveform data;

sequentially extracting blocks of the waveform values from the series of the waveform values in a reverse direction of the time axis from present to past;

rearranging the series of the waveform values by thinning out waveform values other than those contained in the extracted bocks so as to reproduce the waveform data when the inputted information indicates the contraction; and otherwise rearranging the series of the waveform vales by duplicating a part of the waveform values contained in the extracted blocks so as to reproduce the waveform data when the inputted information indicates the expansion.

32. A machine-readable medium for use in a music apparatus having a central processing unit, the medium containing program instructions executable by the central processing unit for causing the music apparatus to perform a process of reproducing waveform data of a tone, wherein the process comprises the steps of:

loading waveform data that represents a series of waveform values of a tone arranged sequentially along a time axis;

inputting information that indicates contraction or expansion of the time axis during the course of reproduction of the waveform data;

sequentially pointing to positions of the waveform values along the time axis in a reverse direction from present to past at a rate corresponding to a degree of the Contraction or expansion indicated by the inputted information;

sequentially extracting blocks of the waveform values from the series of the waveform values based on the sequentially pointed positions so as to reproduce the waveform data; and repeating a part of a current block until the position advances to a next block if the position does not yet reach the next block.

33. A machine-readable medium for use in a music apparatus having a central processing unit, the medium program instructions executable by the central processing unit for causing the music apparatus to perform a process or reproducing waveform data of a tone, wherein the process comprises the steps of:

loading waveform data that represents a series of waveform values of a tone arranged sequentially along a time axis;

inputting information that indicates contraction or expansion of the time axis during the course of reproduction of the waveform data;

sequentially extracting blocks of the waveform values from the series of the waveform values in a reverse direction of the time axis from present to past such that each block has a length determined according to a degree of the contraction or extraction indicated by the inputted information; and rearranging the extracted blocks so as to reproduce the waveform data.

34. A machine-readalbe medium for use in a music apparatus having a central processing unit, the medium containing program instructions exectuable by the central processing unit for causing the music apparatus to perform a process of reproducing waveform data of a tone, wherein the process comprises the steps of:

loading waveform data that represents a series of waveform values of tones arranged sequentially along a time axis;

inputting information that indicates contraction or expansion of the time axis during the course of reproduction of the waveform data;

sequentially pointing to positions of the waveform values along the time axis in a reverse direction from present to past at a rate corresponding to a degree of the contraction or expansion indicated by the inputted information;

sequentially extracting blocks of the waveform values from the series of the waveform values based on the sequentially pointed positions; and rearranging the blocks so as to reproduce the waveform data.

* * * * *